US012735649B2

(12) United States Patent
Hu et al.

(10) Patent No.: US 12,735,649 B2
(45) Date of Patent: Sep. 15, 2026

(54) HYDROCRACKING PROCESS AND SYSTEM

(71) Applicants: CHINA PETROLEUM & CHEMICAL CORPORATION, Beijing (CN); SINOPEC Research Institute of Petroleum Processing Co., Ltd., Beijing (CN)

(72) Inventors: Zhihai Hu, Beijing (CN); Changyi Mo, Beijing (CN); Liang Ren, Beijing (CN); Yichao Mao, Beijing (CN); Li Zhuang, Beijing (CN); Xinheng Cai, Beijing (CN); Yi Zhao, Beijing (CN); Guangle Zhao, Beijing (CN); Zhangyan Yan, Beijing (CN); Yang Zhao, Beijing (CN)

(73) Assignees: CHINA PETROLEUM & CHEMICAL CORPORATION, Beijing (CN); SINOPEC RESEARCH INSTITUTE OF PETROLEUM PROCESSING CO., LTD., Beijing (CN)

( * ) Notice: Subject to any disclaimer, the term of this patent is extended or adjusted under 35 U.S.C. 154(b) by 94 days.

(21) Appl. No.: 18/692,008

(22) PCT Filed: Sep. 14, 2022

(86) PCT No.: PCT/CN2022/118720
§ 371 (c)(1),
(2) Date: Mar. 14, 2024

(87) PCT Pub. No.: WO2023/040890
PCT Pub. Date: Mar. 23, 2023

(65) Prior Publication Data

US 2024/0384186 A1 Nov. 21, 2024

(30) Foreign Application Priority Data

Sep. 14, 2021 (CN) ..... 202111072186.8

(51) Int. Cl.
*C10G 65/12* (2006.01)

(52) U.S. Cl.
CPC ..... *C10G 65/12* (2013.01); *C10G 2300/1029* (2013.01); *C10G 2300/301* (2013.01);
(Continued)

(58) Field of Classification Search
CPC ..... C10G 2300/1029; C10G 2300/107; C10G 2300/1074; C10G 2300/301;
(Continued)

(56) References Cited

U.S. PATENT DOCUMENTS

| | | | |
|---|---|---|---|
| 5,292,976 | A | 3/1994 | Dessau et al. |
| 10,639,618 | B2 | 5/2020 | Liu et al. |
| 2018/0037829 | A1 | 2/2018 | Calla et al. |

FOREIGN PATENT DOCUMENTS

| | | | | |
|---|---|---|---|---|
| CN | 103666555 | A | * | 3/2014 |
| CN | 104560156 | A | | 4/2015 |

OTHER PUBLICATIONS

CN-103666555-A English Translation (Year: 2014).*
(Continued)

*Primary Examiner* — Ellen M Mcavoy
*Assistant Examiner* — Chantel Graham
(74) *Attorney, Agent, or Firm* — Panitch Schwarze Belisario & Nadel LLP

(57) ABSTRACT

The invention relates to a hydrocracking process and system. The gas oil feedstock and hydrogen are mixed and reacted in a hydrotreating unit. The resulting reaction effluent is sent to a first hydrogenation cracking unit and reacted by contacting a hydrogenation cracking catalyst I to obtain light fraction I rich in paraffins and heavy fraction I rich in cyclic hydrocarbons. The heavy fraction I is mixed with hydrogen and reacted in a second hydrogenation cracking unit, thereby producing heavy fraction II rich in cyclic
(Continued)

hydrocarbons. The present invention wholly realizes the high-selective directional conversion of gas oil feedstock according to the chain structure and the ring structure and can produce chemical raw materials rich in paraffins and naphthenic specialty oil rich in cyclic hydrocarbons.

30 Claims, 1 Drawing Sheet

(52) U.S. Cl.
CPC ..... *C10G 2300/4006* (2013.01); *C10G 2300/4012* (2013.01); *C10G 2300/4018* (2013.01); *C10G 2300/70* (2013.01); *C10G 2400/30* (2013.01)

(58) Field of Classification Search
CPC .... C10G 2300/4006; C10G 2300/4012; C10G 2300/4018; C10G 2300/70; C10G 2400/30; C10G 45/08; C10G 47/04; C10G 47/12; C10G 47/16; C10G 47/20; C10G 47/36; C10G 65/00; C10G 65/12; C10G 67/02; C10G 69/00; C10G 69/04; C10G 9/36
See application file for complete search history.

(56) References Cited

OTHER PUBLICATIONS

Rahimi et al., "Catalytic cracking of hydrocarbons over modified ZSM-5 zeolites to produce light olefines: A Review," Applied Catalysis A: General, vol. 398, pp. 1-17 (2011). (Cited in the Examination Report issued on Jun. 24, 2026, by the Indian Patent Office in corresponding IN Application No. 202447028810).

* cited by examiner

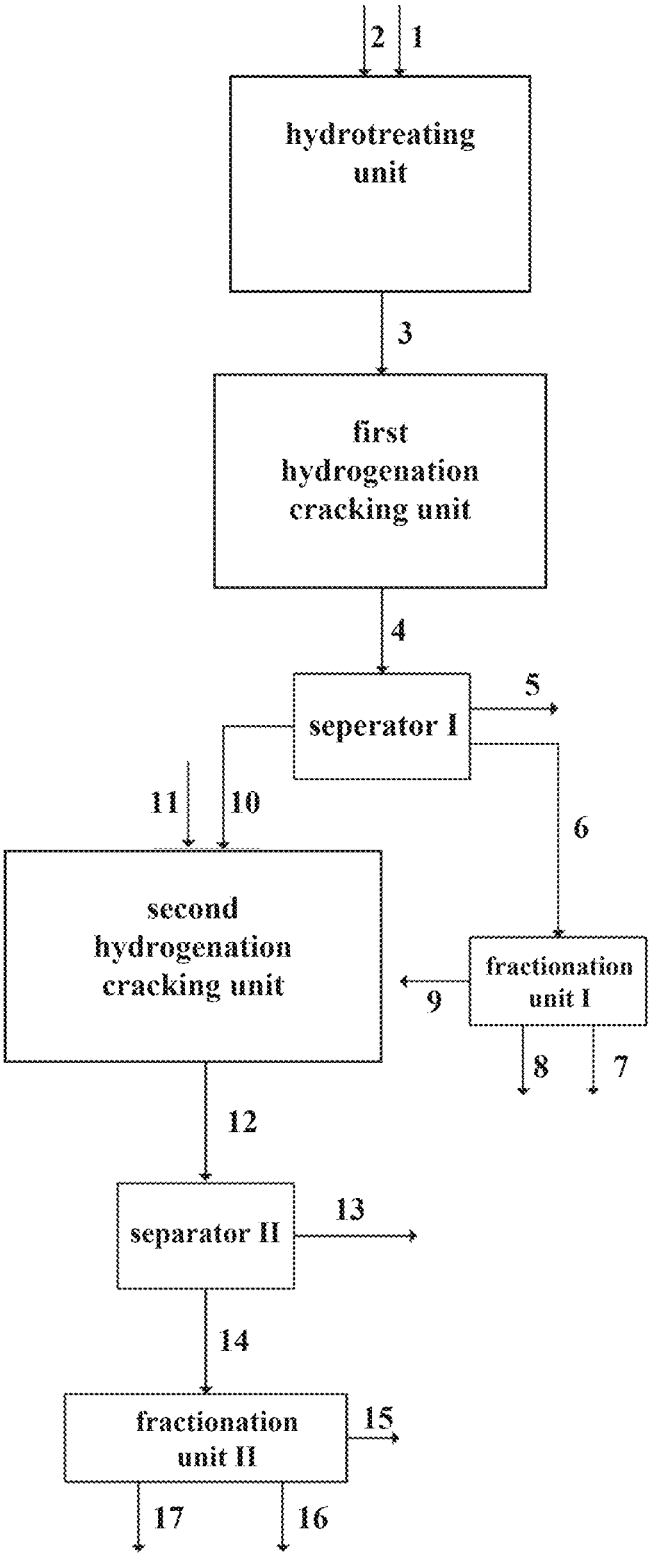
2
1
hydrotreating unit
3
first hydrogenation cracking unit
4
5
seperator I
11
10
6
second hydrogenation cracking unit
fractionation unit I
9
8
7
12
separator II
13
14
fractionation unit II
15
17
16

HYDROCRACKING PROCESS AND SYSTEM

TECHNICAL FIELD

The invention relates to the technical field of hydrocarbon raw material processing and specifically relates to a process and system for hydrocracking gas oil feedstock.

BACKGROUND

Among crude oil secondary processing technologies, hydrocracking technology has the advantages of strong raw material adaptability, flexible production operations and product plans, and excellent product quality. It can convert feedstock oil into clean fuels and chemical raw materials and is one of the important processing technologies for adjusting product distribution and product quality and combining oils and chemical products in refining and chemical enterprises.

The feedstock oil for hydrocracking is usually gas oil (tar or fuel oil). The gas oil feedstock is composed of paraffins, naphthenes and aromatics molecules, and the carbon number range is about 20-40. In the existing technology, conventional hydrogenation cracking catalysts mainly use Y-type or β-type molecular sieves as catalytic materials and utilize the acidic function of its catalytic materials to perform chain scission reactions. Therefore, in the process of converting gas oil feedstock using conventional hydrocracking technology, in addition to the ring-opening cracking reaction of naphthenes, chain scission reactions will also occur on the long side chains of paraffins, aromatics or naphthenes molecules, causing the simultaneous presence of paraffins, naphthenes with side chains, and aromatics with side chains in each product fraction, resulting in difficulty in achieving efficient enrichment of paraffins for a feedstock for producing ethylene by steam cracking (tail oil, light naphtha) in the hydrocracking product, and difficulty in achieving efficient enrichment of naphthenes and aromatics for a reforming feedstock (heavy naphtha) in its product.

CN87105808A discloses an improved process for hydrodewaxing hydrocracked lube oil base stocks, comprising a hydrocracked or solvent-dewaxed lube oil base stock is successively passed through a catalyst bed with hydrodewaxing activity and a hydrofinishing catalyst bed, thereby producing a lube oil base stock product with a reduced cloud point.

CN102959054A discloses an integrated hydrocracking and dewaxing method of hydrocarbons. In this method, the feedstock oil is successively hydrotreated and then reacted in the first hydrocracking reaction zone to obtain a first hydrocracked reaction effluent, which is sent to a first catalytic dewaxing reaction zone to react. The resulting reaction effluent is separated and fractionated to obtain a naphtha fraction, a first diesel fraction and a bottom product fraction, wherein the bottom product fraction is reacted in a second hydrocracking or a second catalytic dewaxing reaction zone. The resulting reaction effluent is separated and fractionated to form a second diesel fraction and a lube product fraction.

CN102311785A discloses a method for hydrogenating naphthenic distillate oil to produce lubricating oil base oil. The method uses naphthenic feedstock oil as raw material and uses a hydrotreating catalyst containing β-type molecular sieve, and a hydrogenation condensation point-reducing catalyst containing ZSM-5 type molecular sieve together with a hydrogenation supplementary refining method to produce a rubber-filling oil product with a reduced pour point.

CN102971401B discloses an integrated process for hydrocracking and dewaxing of hydrocarbons. In this process, the feedstock oil is first hydrotreated, and the hydrotreated product is separated to obtain a liquid phase residue for catalytic dewaxing and hydrocracking reactions. The reaction effluent is separated and fractionated to obtain a diesel product fraction and a lubricating oil base oil product fraction.

CN106669803A discloses a catalyst for producing high viscosity index hydrocracking tail oil and its preparation process. The process comprises mixing macroporous alumina, a modified USY molecule sieve and a modified ZSM-48 molecular sieve to prepare a catalyst. The feedstock undergoes hydrogenation ring-opening and hydroisomerization reactions with this catalyst to produce lubricating oil base oil products with low linear-alkane content, high isomeric hydrocarbon content and high viscosity index.

From the existing technologies listed above, it can be seen that the main problems of conventional hydrocracking technology are: First, conventional hydrocracking technology mainly uses a hydrogenation cracking catalyst containing Y-type molecular sieve to convert a gas oil feedstock into product fractions with reduced boiling ranges, but the corresponding cracking reaction according to the molecular structure composition cannot occur, and the efficient conversion of gas oil feedstock hydrocarbon molecules according to the hydrocarbon molecular structure type cannot be achieved, and the product quality and added value are low. Secondly, in the case of producing high-value-added naphthenic speciality products, either the existing hydrocracking technology has a limitation that only naphthenic gas oil can be used, or by using a catalytic dewaxing reaction unit to convert normal-paraffins into iso-paraffins having branched chains to improve the low-temperature fluidity of the product, it needs complex process, high equipment investment and high operation cost.

Therefore, the development of a carbon chain cascade conversion and hydrocracking technology that can meet the separate conversion of gas oil feedstock molecules according to the chain structure and the ring structure has important practical significance for realizing efficient utilization of gas oil feedstock.

SUMMARY OF THE INVENTION

The present invention is to solve the problems in the existing hydrocracking technology of low-added-value products and low utilization efficiency of gas oil feedstock molecules caused by the indiscriminate conversion of molecular structures of the gas oil feedstock.

The first aspect of the present invention provides a hydrocracking process, comprising:

(1) in a hydrotreating unit, a mixture of gas oil feedstock and hydrogen gas is reacted by successively contacting a hydrogenation protection agent, an optional hydrodemetallization catalyst, and a hydrorefining catalyst, to produce a reaction effluent;

(2) in a first hydrogenation cracking unit, the reaction effluent obtained from step (1) is sent to the first hydrogenation cracking unit, and reacted by contacting a hydrogenation cracking catalyst I in presence of hydrogen gas, the resulting reaction effluent is separated to at least produce light fraction I and heavy fraction I; the light fraction I is rich in paraffins, the mass fraction of paraffins in the light fraction I is at least 82%, the heavy fraction I is rich in naphthenes and aromatics, in hydrocarbon composition of the >350° C.

fraction of the heavy fraction I, the sum of the mass fractions of naphthenes and aromatics is higher than 82%;

(3) in a second hydrogenation cracking unit, the heavy fraction I obtained in step (2) is sent to the second hydrogenation cracking unit, and reacted by contacting a hydrogenation cracking catalyst II and/or a hydrotreating catalyst in presence of hydrogen gas, the resulting reaction effluent is separated to at least produce light fraction II and heavy fraction II.

In the present invention, the gas oil feedstock has an initial boiling point of 300-350° C. and is one or more of atmospheric gas oil, vacuum gas oil, hydrogenated gas oil, coker gas oil, catalytic cracking heavy cycle oil, and deasphalted oil.

In order to improve the utilization value of the hydrocarbon molecules in gas oil feedstock, the present invention provides a hydrocracking process based on the molecular structure characteristics of hydrocarbons. According to the present invention, a mixture of gas oil feedstock and hydrogen gas is first reacted by contacting in the hydrotreating unit. The reaction effluent is sent to the first hydrogenation cracking unit and reacted with the hydrogenation cracking catalyst I to achieve the selective conversion of chain structures of the gas oil feedstock to obtain light fraction I rich in paraffins and heavy fraction I rich in cyclic hydrocarbons (naphthenes and aromatics). The heavy fraction I is mixed with hydrogen gas and then sent to a second hydrogenation cracking unit to react with a hydrogenation cracking catalyst II and/or a hydrotreating catalyst, thereby obtaining light fraction II rich in naphthenes and aromatics and heavy fraction II rich in cyclic hydrocarbons with good low-temperature fluidity. The present invention wholly realizes the selective and efficient conversion of gas oil feedstock according to the types of the chain structure and the ring structure of hydrocarbon molecules and obtains product fractions rich in paraffins and rich in cyclic hydrocarbons respectively.

Depending on the separation manner, there are various plans for cutting the reaction effluent. In one embodiment of the present invention, the resulting reaction effluent of the first hydrogenation cracking unit is separated to produce light fraction I and heavy fraction I. The light fraction I has an initial boiling point of 20° C.-30° C. The light fraction I and the heavy fraction I have a cutting point of 65° C.-120° C., preferably 65-105° C. The light fraction I is rich in paraffins, preferably the mass fraction of paraffins in the light fraction I is at least 85%. The light fraction I rich in paraffins can be used as a high-quality feedstock for producing ethylene by steam cracking. The resulting heavy fraction I is rich in naphthenes and aromatics. In hydrocarbon composition of the >350° C. fraction of the heavy fraction I, the sum of the mass fractions of naphthenes and aromatics is higher than 82%.

In another embodiment of the present invention, the resulting reaction effluent of the first hydrogenation cracking unit is separated to produce light fraction I, middle fraction I and heavy fraction I. The light fraction I has an initial boiling point of 20° C.-30° C. The light fraction I and the middle fraction I have a cutting point of 65° C.-120° C., preferably 65-105° C. The middle fraction I and the heavy fraction I have a cutting point of 160-180° C. The light fraction I is rich in paraffins, preferably the mass fraction of paraffins in the light fraction I is at least 85%. The middle fraction I can be used as a separate product, or it can be sent to a fractionation column of the second hydrogenation cracking unit and further cut to obtain parts of light fraction II component and heavy fraction II component. The resulting heavy fraction I is rich in naphthenes and/or aromatics. In hydrocarbon composition of the >350° C. fraction of the heavy fraction I, the sum of the mass fractions of naphthenes and aromatics is higher than 82%.

In order to further improve the utilization value of hydrocarbon molecules in heavy fraction I, according to the present invention, the heavy fraction I is sent to the second hydrogenation cracking unit for selective cracking reaction. The resulting reaction effluent is separated to produce light fraction II and heavy fraction II. In an embodiment of the present invention, the obtained light fraction II has an initial boiling point of 65° C.-100° C. The light fraction II and heavy fraction II have a cutting point of 155-180° C., preferably 160-175° C. The light fraction II has a total mass fraction of naphthenes and aromatics of at least 58%, and it is a high-quality reforming material. According to different product plans, there are various plans for cutting the obtained heavy fraction II. According to various cutting plans, the heavy fraction II can be cut into a variety of naphthenic speciality oils such as high gravity jet fuel fraction, transformer oil base oil, and refrigerator oil. In an embodiment of the present invention, the mass fraction of naphthenes in the >350° C. fraction of the obtained heavy fraction II is at least 50%. The heavy fraction II rich in naphthenes has good low-temperature fluidity. The heavy fraction II can be used as various high value-added naphthenic speciality oils.

In an embodiment of the present invention, in the hydrotreating unit, based on the whole catalyst of the hydrotreating unit, the loading volumetric fractions of the hydrogenation protection agent, the optional hydrodemetallization catalyst, and the hydrorefining catalyst are 3%-10%; 0%-20%; and 70%-90% respectively.

The hydrogenation protection agent is a conventional hydrogenation protection agent for heavy hydrocarbon oil processing in the art, and not limited to gas oil hydrogenation protection agent, residual oil hydrogenation protection agent, or a combination thereof.

Preferably, the hydrogenation protection agent contains a support and, loaded on the support, an active metal component, the support is one or more of alumina, silica, and titania, the active metal component is one or more of Group VIB metal(s), and Group VIII non-precious metal(s), based on the weight of the hydrogenation protection agent, as oxide, the active metal component comprises 0.1-15 wt %, the hydrogenation protection agent has a particle size of 0.5-50.0 mm, a bulk density of 0.3-1.2 g/cm$^3$, and a specific surface area of 50-300 m$^2$/g.

The hydrodemetallization catalyst is a conventional hydrodemetallization catalyst for heavy hydrocarbon oil processing in the art, and not limited to gas oil hydrodemetallization catalyst, residual oil hydrodemetallization catalyst, or a combination thereof.

Preferably, the hydrodemetallization catalyst contains a support and, loaded on the support, an active metal component, the support is one or more of alumina, silica, and titania, the active metal component is one or more of Group VIB metal(s), and Group VIII non-precious metal(s), based on the weight of the hydrodemetallization catalyst, as oxide, the active metal component comprises 3-30 wt %, the hydrodemetallization catalyst has a particle size of 0.2-2.0 mm, a bulk density of 0.3-0.8 g/cm$^3$, and a specific surface area of 100-250 m$^2$/g.

In the present invention, "optional" means that the corresponding step, catalyst or component is optional but not necessary, that is, the step, catalyst or component may or may not be present.

In an embodiment of the present invention, the hydrorefining catalyst is a supported catalyst, the support is alumina and/or silica-alumina, the active metal component is at least one selected from Group VIB metals and/or at least one selected from Group VIII metals; the Group VIII metal is Ni and/or Co, the Group VIB metal is Mo and/or W, based on the total weight of the hydrorefining catalyst, as oxide, the content of Group VIII metal(s) is 1-15 wt %, the content of Group VIB metal(s) is 5-40 wt %, Preferably, the active metal component of the hydrorefining catalyst is two or three of metals Ni, Mo and W.

In an embodiment of the present invention, the hydrotreating unit has the following reaction conditions: hydrogen partial pressure: 3.0 MPa-20.0 MPa, reaction temperature: 280° C.-400° C., LHSV (liquid hourly space velocity): 0.5 $h^{-1}$-6 $h^{-1}$, $H_2$/oil ratio by volume: 300-2000.

Preferably, in the hydrotreating unit, an aromatics saturation rate of feedstock is controlled to less than or equal to 58%. The inventor of the present invention conducted in-depth research and found that, if the aromatics saturation rate is too high, when the reaction effluent of the hydrotreating unit is sent to the first hydrogenation cracking unit, it will lead to an increase in the ring-opening cracking reaction of naphthenes in the first hydrogenation cracking unit, which will have an adverse influence on the reaction effect of the directional conversion of gas oil feedstock according to the chain structure and the ring structure.

The aromatics saturation rate of feedstock=100%*(the content of aromatics in feedstock−the content of aromatics in reaction effluent of hydrotreating unit)/the content of aromatics in feedstock.

Herein, contents are based on weight unless otherwise stated.

In an embodiment of the present invention, the first hydrogenation cracking unit has the following reaction conditions: hydrogen partial pressure: 3.0 MPa-20.0 MPa, reaction temperature: 280° C.-400° C., LHSV: 0.5 $h^{-1}$-6 $h^{-1}$, $H_2$/oil ratio by volume: 300-2000.

In order to better realize the selective and efficient conversion of gas oil feedstock according to the types of the chain structure and the ring structure of hydrocarbon molecules, in an embodiment of the present invention, the conversion of >350° C. fraction in the first hydrogenation cracking unit is controlled to the following range:

from 100*(Awt %/the mass fraction of >350° C. fraction in gas oil feedstock) to 100*(Bwt %/the mass fraction of >350° C. fraction in gas oil feedstock), wherein, A is the mass fraction of paraffins in gas oil feedstock, B is the sum of mass fractions of paraffins, monocycloparaffins, and monocyclic aromatics in gas oil feedstock, wherein, the conversion of >350° C. fraction in the first hydrogenation cracking unit=100%*(the mass fraction of >350° C. fraction in gas oil feedstock−the mass fraction of >350° C. fraction in the reaction product of the first hydrogenation cracking unit)/the mass fraction of >350° C. fraction in gas oil feedstock.

Similarly in order to better realize the selective and efficient conversion of gas oil feedstock according to the types of the chain structure and the ring structure of hydrocarbon molecules, in an embodiment of the present invention, in the first hydrogenation cracking unit, one or more process condition parameters of reaction temperature, LHSV, $H_2$/oil ratio and reaction pressure, preferably reaction temperature and LHSV, of the first hydrogenation cracking unit are adjusted so that the conversion of paraffins in the feedstock is 56%-95%, the total conversion of naphthenes and aromatics is 10%-65%, wherein the conversion of paraffins=(the content of paraffins in the feedstock−the content of paraffins in the >350° C. fraction of the product of the first hydrogenation cracking unit*the mass fraction of the >350° C. fraction in the product of the first hydrogenation cracking unit)/the content of paraffins in the feedstock;

the total conversion of naphthenes and aromatics=(the total content of naphthenes and aromatics in the feedstock−the total content of naphthenes and aromatics in >350° C. fraction of the product of the first hydrogenation cracking unit*the mass fraction of the >350° C. fraction in the product of the first hydrogenation cracking unit)/the total content of naphthenes and aromatics in the feedstock.

For the aromatics saturation rate of feedstock, as well as for the conversion of >350° C. fraction, the conversion of paraffins, and the conversion of naphthenes+aromatic in the first hydrogenation cracking unit, those skilled in the art know how to control them by appropriately setting operation parameters such as hydrogen partial pressure or reaction pressure, reaction temperature, LHSV, and $H_2$/oil ratio by volume. For example, reaction temperature and LHSV, especially reaction temperature will have the most significant impact(s) on the saturation rate/conversion.

For the aromatics saturation rate of feedstock, as well as for the conversion of >350° C. fraction, the conversion of paraffins, and the conversion of naphthenes+aromatic in the first hydrogenation cracking unit, operation parameters are determined as follows, to control saturation rate and/or conversion:

(1) setting a target difference between the actual saturation rate/conversion and the target saturation rate/conversion, such as 20%, (2) pre-determining a group of operation parameters, including hydrogen partial pressure or reaction pressure, reaction temperature, LHSV, and $H_2$/oil ratio by volume, and determining an actual saturation rate/conversion under the pre-determined operation parameters, (3) when the absolute value of the difference between the actual saturation rate/conversion and the target saturation rate/conversion is greater than the target difference, using a certain step size as the initial step size and increasing or decreasing the operation temperature until the absolute value of the difference between the actual saturation rate/conversion and the target saturation rate/conversion is less than the target difference;

reducing the step size if the operation temperature is increased or decreased with this step size and the absolute value of the difference between the actual saturation rate/conversion and the target saturation rate/conversion being less than the target difference can never be achieved within the operation temperature range, and starting from the predetermined temperature, increasing or decreasing the operation temperature until the absolute value of the difference between the actual saturation rate/conversion and the target saturation rate/conversion is less than the target difference;

(4) using the temperature determined in step (3) as the predetermined temperature in step (4), using a step size smaller than the initial step size in step (3) as the initial step size in step (4), and using a target difference smaller than the target difference in step (3) as the target difference in step (4), repeating step (3);

(5) performing step (3) or (4), or repeating step (4) until the desired absolute value of the difference between the actual saturation rate/conversion and the target saturation rate/conversion is reached, thereby determining the operation temperature and achieving the control of the saturation rate/conversion;

optionally, re-determining the operation parameters of step (2) if the absolute value of the difference between the actual saturation rate/conversion and the target saturation rate/conversion being less than the target difference can never be achieved, or if the desired absolute value of the difference between the actual saturation rate/conversion and the target saturation rate/conversion can never be achieved, for example, increasing or decreasing one or more of hydrogen partial pressure or reaction pressure, LHSV, and $H_2$/oil ratio by volume by a factor of 10%, 9%, 8%, 7%, 6%, 5%, 4%, 3%, 2%, 1% or a higher or lower value, and repeating step (2).

For example, those skilled in the art can first predetermine a group of operation parameters, and determine an actual saturation rate/conversion under the pre-determined operation parameters. If the actual saturation rate/conversion differs from the target saturation rate/conversion by more than 20%, the operation temperature is increased or decreased in a step size of 16° C. until the actual saturation rate/conversion differs from the target saturation rate/conversion by less than 20%; if the operation temperature is increased or decreased in a step size of 16° C., and the actual saturation rate/conversion differing from the target saturation rate/conversion by less than 20% can never be achieved, the step size is changed to 8° C., 4° C., 2° C. or 1° C. When the actual saturation rate/conversion differs from the target saturation rate/conversion by less than 20%, the temperature is changed in a step size of 8° C., 4° C., 2° C. and 1° C. one after another as needed until the desired saturation rate/conversion is achieved. If the desired saturation rate/conversion can never be achieved, a group of operation parameters is pre-determined again and the above process is repeated.

Those skilled in the art know how to select specific operation conditions e.g., reaction temperature, space velocity, hydrogen-to-oil ratio and hydrogen partial pressure within the range of given operation conditions to achieve the desired saturation rate/conversion. For the technical solution of the present application, a fixed bed hydrocracking process is used. Usually under a certain feedstock processing capacity, the adjustment ranges of space velocity, hydrogen-to-oil ratio and hydrogen partial pressure are relatively small. Those skilled in the art mainly affect the conversion of >350° C. fraction, the conversion of paraffins, and the conversion of naphthenes+aromatic in the first hydrogenation cracking unit by adjusting the cracking reaction temperature. Therefore, operation parameters can also be determined as follows, to control the conversions:

a linear relationship between the reaction temperature of the first hydrogenation cracking unit and the conversion of >350° C. fraction, the conversion of paraffins, and the conversion of naphthenes+aromatic in the first hydrogenation cracking unit is determined, which satisfies:

$$y_{conversion}=a^{*}\text{reaction temperature value}-B,$$

wherein the range of a is 0.10-4.0, and the range of B is 30-300;

for the conversion of >350° C. fraction in the first hydrogenation cracking unit, in the linear relationship formula, the range of parameter a is 0.3-3.0, and the range of parameter B is 100-300;

for the conversion of paraffins, in the linear relationship formula, the range of parameter a is 0.2-2.0, and the range of parameter B is 40-150;

for the conversion of naphthenes+aromatic, in the linear relationship formula, the range of parameter a is 0.25-2.5, and the range of parameter B is 60-250;

the operation temperature is determined with the above conversion linear relationship formula.

In the present invention, "monocycloparaffins" in the gas oil feedstock mainly refers to monocyclic naphthenes with long side chains, and "monocyclic aromatics" in the gas oil feedstock mainly refers to monocyclic aromatic hydrocarbons with long side chains. The carbon number of the long-side chain hydrocarbon is greater than 20.

In an embodiment of the present invention, the hydrogenation cracking catalyst I comprises a support and an active metal component, the support comprises heat-resistant inorganic oxides and molecular sieves, the heat-resistant inorganic oxide is one or more of silica and alumina, the active metal component is at least two metal components of Group VIB metals and Group VIII metals; based on the whole of hydrogenation cracking catalyst I, as oxide, Group VIB metal comprises 10 wt %-35 wt %, Group VIII metal comprises 2 wt %-8 wt %;

based on the support, the molecular sieve comprises 10 wt %-75 wt %, preferably, 20 wt %-60 wt %, e.g. 35 wt %-45 wt %, the balance is the heat-resistant inorganic oxide, the molecular sieve has a silica/alumina molar ratio of 20-50, and a pore size of 0.4 nm-0.58 nm.

Preferably, the molecular sieve is one or more of molecular sieves ZSM-5, ZSM-11, ZSM-12, ZSM-22, ZSM-23, ZSM-48, ZSM-50, IM-5, MCM-22, and EU-1, further preferably ZSM-5.

In an embodiment of the present invention, the second hydrogenation cracking unit has the following reaction conditions: hydrogen partial pressure: 3.0 MPa-20.0 MPa, reaction temperature: 280° C.-400° C., LHSV: 0.5 $h^{-1}$-6 $h^{-1}$, $H_2$/oil ratio by volume: 300-2000.

In an embodiment of the present invention, the conversion of >350° C. fraction in the second hydrogenation cracking unit is controlled to a range of 5%-80%. In an embodiment of the present invention, in order to obtain a refrigerator oil product, preferably the conversion of >350° C. fraction in the second hydrogenation cracking unit is controlled to a range of 5%-20%. In an embodiment of the present invention, in order to obtain a transformer oil product, preferably the conversion of >350° C. fraction in the second hydrogenation cracking unit is controlled to a range of 21%-40%. By continuing to increase the conversion of >350° C. fraction, a high aromatic latent reforming stock can be obtained in an increased yield.

If a too high conversion of >350° C. fraction is controlled in the second hydrogenation cracking unit, it will not only reduce the content of naphthenes and aromatics in the light fraction II, but also cause the fraction quality index of the heavy fraction II product to fail to meet the quality requirements of naphthenic speciality oil.

Herein, the conversion of >350° C. fraction in the second hydrogenation cracking unit=100%*(the mass fraction of >350° C. fraction of heavy fraction I−the mass fraction of >350° C. fraction of heavy fraction II)/the mass fraction of >350° C. fraction of heavy fraction I.

In an embodiment of the present invention, the hydrogenation cracking catalyst II comprises a support and an active metal component, said support comprises heat-resistant inorganic oxides and Y-type molecular sieves, the heat-resistant inorganic oxide is one or more of silica, alumina, and titania, the active metal component is at least two metal components of Group VIB metals and Group VIII metals; based on the whole of hydrogenation cracking catalyst II, as oxide, Group VIB metal comprises 10 wt %-35 wt %, Group VIII metal comprises 2 wt %-8 wt %;

based on the support, the Y-type molecular sieve comprises 5 wt %-55 wt %, the balance is the heat-resistant inorganic oxide.

In an embodiment of the present invention, the hydrotreating catalyst is a supported catalyst, the support is alumina or silica-alumina, the active metal component is at least one selected from Group VIB metals and/or at least one selected from Group VIII metals, the Group VIII metal is Ni and/or Co, the Group VIB metal is Mo and/or W, based on the total weight of the hydrotreating catalyst, as oxide, the content of Group VIII metal(s) is 1-15 wt %, the content of Group VIB metal(s) is 5-40 wt %.

The second aspect of the present invention provides a hydrocracking system, comprising: a hydrotreating unit, a first hydrogenation cracking unit, and a second hydrogenation cracking unit;

the hydrotreating unit is provided with a gas oil feedstock inlet, a hydrogen gas inlet, and a reaction effluent outlet, in the hydrotreating unit are successively loaded a hydrogenation protection agent, optionally a hydrodemetallization catalyst, and a hydrorefining catalyst;

the first hydrogenation cracking unit is provided with a first hydrogenation cracking system and a first separation system, in the first hydrogenation cracking system is loaded a hydrogenation cracking catalyst I, the first hydrogenation cracking system is provided with an inlet for the reaction effluent of the hydrotreating unit, which is communicated with the reaction effluent outlet of the hydrotreating unit, a reaction effluent outlet of the first hydrogenation cracking system is communicated with an inlet of the first separation system, the first separation system is at least provided with a first hydrogen-rich gas outlet, a light fraction I outlet and a heavy fraction I outlet;

the second hydrogenation cracking unit is provided with a second hydrogenation cracking system and a second separation system, in the second hydrogenation cracking system are loaded a hydrogenation cracking catalyst II and/or a hydrotreating catalyst, the second hydrogenation cracking system is provided with an inlet for heavy fraction I, which is communicated with the heavy fraction I outlet of the first separation system, a reaction effluent outlet of the second hydrogenation cracking system is communicated with an inlet for the second separation system, the second separation system is at least provided with a second hydrogen-rich gas outlet, a light fraction II outlet, and a heavy fraction II outlet.

In an embodiment of the present invention, the first separation system and the second separation system are respectively provided with respective gas-liquid separators and fractionation columns. They are not limited to various combinations of hot high-pressure separators, cold high-pressure separators, hot low-pressure separators, and cold low-pressure separators with fractionating columns, as long as they meet the separation requirements of the present invention.

In order to improve the utilization value of hydrocarbon molecules in gas oil feedstock, the present invention discloses a hydrocracking process and system based on the molecular structure characteristics of hydrocarbons.

The present invention is characterized in that it can realize the selective and efficient conversion of gas oil feedstock according to the types of the chain structure and the ring structure of hydrocarbon molecules, to obtain product fractions rich in paraffins and product fractions rich in cyclic hydrocarbons, in which the light fraction I rich in paraffins can meet the content of paraffins of ≥82 wt %, and can be used as a high-quality feedstock for producing ethylene by steam cracking; the light fraction II rich in cyclic hydrocarbons can meet the sum of mass fractions of naphthenes and aromatics of ≥58 wt %, and can be used as a high-quality reforming feedstock; in addition, the heavy fraction II product rich in naphthenes has good low-temperature fluidity and can be used as a high-value-added naphthenic speciality oil.

The present invention can wholly realize the separate conversion of chain hydrocarbons and cyclic hydrocarbons (naphthenes and aromatics) in the gas oil feedstock, and enrich them in each product fraction respectively so that no additional processing is required to directly obtain paraffins-rich light naphtha that can be used as chemical raw materials and high value-added naphthenic speciality oil, which has a great significance for refining and chemical companies to achieve high-value utilization of gas oil feedstock at low cost.

DESCRIPTION OF THE DRAWINGS

FIG. 1 is a schematic diagram of one embodiment of the hydrocracking process provided by the present invention.

DETAILED DESCRIPTION

The present invention will be further described below in conjunction with the accompanying drawings, but the invention is not limited thereby.

FIG. 1 is a schematic diagram of one embodiment of the hydrocracking process provided by the present invention. As shown in FIG. 1, gas oil feedstock 1 and hydrogen gas 2 are reacted in a hydrotreating unit by successively contacting a hydrogenation protection agent, an optional hydrodemetallization catalyst, and a hydrorefining catalyst. The resulting reaction effluent 3 is sent to a first hydrogenation cracking unit, and reacted by contacting a hydrogenation cracking catalyst I in presence of hydrogen gas. The resulting reaction effluent 4 is separated in a separator I to produce a hydrogen-rich gas 5, a first liquid phase stream 6 and a heavy fraction I 10. The resulting first liquid phase stream 6 is sent to a fractionation unit I for fractionating to produce a low carbon light hydrocarbon 7, a light fraction I 8, a bottom oil 9 (middle fraction I). The obtained bottom oil 9 can be sent to a fractionation unit II for further fractionating. The obtained heavy fraction I 10 and hydrogen gas 11 are reacted in a second hydrogenation cracking unit by contacting a hydrogenation cracking catalyst II and/or a hydrotreating catalyst. The resulting reaction effluent 12 is separated in a separator II to produce a hydrogen-rich gas 13 and a second liquid phase stream 14. The obtained second liquid phase stream 14 is sent to the fractionation unit II for fractionating to produce a top oil 15, a light fraction II 16 and a heavy fraction II 17. The obtained top oil 15 can be sent to the fractionation unit I for further fractionating.

The present invention provides the following technical solutions and any combination thereof:

1. A hydrocracking process, comprising:

(1) in a hydrotreating unit, a mixture of gas oil feedstock and hydrogen gas is reacted by successively contacting a hydrogenation protection agent, an optional hydrodemetallization catalyst, and a hydrorefining catalyst, to produce a reaction effluent;

(2) in a first hydrogenation cracking unit, the reaction effluent obtained from step (1) is sent to the first hydrogenation cracking unit, and reacted by contacting a hydrogenation cracking catalyst I in presence of hydrogen gas, the resulting reaction effluent is separated to at least produce light fraction I and heavy fraction I; the light fraction I is rich in paraffins, the mass fraction of paraffins in the light fraction I is at least 82%, the heavy fraction I is rich in naphthenes and aromatics, in hydrocarbon composition of the >350° C. fraction of the heavy fraction I, the sum of the mass fractions of naphthenes and aromatics is higher than 82%;

(3) in a second hydrogenation cracking unit, the heavy fraction I obtained in step (2) is sent to the second hydrogenation cracking unit, and reacted by contacting a hydrogenation cracking catalyst II and/or a hydrotreating catalyst in presence of hydrogen gas, the resulting reaction effluent is separated to at least produce light fraction II and heavy fraction II.

2. The process according to any one of previous technical solutions, which is characterized in that the gas oil feedstock has an initial boiling point of 300-350° C. and is one or more of atmospheric gas oil, vacuum gas oil, hydrogenated gas oil, coker gas oil, catalytic cracking heavy cycle oil, and deasphalted oil.

3. The process according to any one of previous technical solutions, which is characterized in that in the hydrotreating unit, based on the whole catalyst of the hydrotreating unit, the loading volumetric fractions of the hydrogenation protection agent, the optional hydrodemetallization catalyst, and the hydrorefining catalyst are 3%-10%; 0%-20%; and 70%-90% respectively.

4. The process according to any one of previous technical solutions, which is characterized in that the hydrotreating unit has the following reaction conditions: hydrogen partial pressure: 3.0 MPa-20.0 MPa, e.g. 8.0 MPa-17.0 MPa, reaction temperature: 280° C.-400° C., e.g. 340-430° C., LHSV (based on the hydrorefining catalyst): 0.5 $h^{-1}$-6 $h^{-1}$, e.g. 0.5 $h^{-1}$-2.0 $h^{-1}$, $H_2$/oil ratio by volume: 300-2000, e.g. 600-1000.

5. The process according to any one of previous technical solutions, which is characterized in that the hydrogenation protection agent contains a support and, loaded on the support, an active metal component, the support is one or more of alumina, silica, and titania, the active metal component is one or more of Group VIB metal(s), and Group VIII non-precious metal(s), based on the weight of the hydrogenation protection agent, as oxide, the active metal component comprises 0.1-15 wt %, the hydrogenation protection agent has a particle size of 0.5-50.0 mm, a bulk density of 0.3-1.2 g/$cm^3$, and a specific surface area of 50-300 $m^2$/g.

6. The process according to any one of previous technical solutions, which is characterized in that the hydrodemetallization catalyst contains a support and, loaded on the support, an active metal component, the support is one or more of alumina, silica, and titania, the active metal component is one or more of Group VIB metal(s), and Group VIII non-precious metal(s), based on the weight of the hydrodemetallization catalyst, as oxide, the active metal component comprises 3-30 wt %, the hydrodemetallization catalyst has a particle size of 0.2-2.0 mm, a bulk density of 0.3-0.8 g/$cm^3$, and a specific surface area of 100-250 $m^2$/g.

7. The process according to any one of previous technical solutions, which is characterized in that the hydrorefining catalyst is a supported catalyst, the support is alumina and/or silica-alumina, the active metal component is at least one selected from Group VIB metals and/or at least one selected from Group VIII metals; the Group VIII metal is Ni and/or Co, the Group VIB metal is Mo and/or W, based on the total weight of the hydrorefining catalyst, as oxide, the content of Group VIII metal(s) is 1-15 wt %, the content of Group VIB metal(s) is 5-40 wt %.

8. The process according to technical solution 7, which is characterized in that the active metal component of the hydrorefining catalyst is two or three of metals Ni, Mo and W.

9. The process according to any one of previous technical solutions, which is characterized in that in the hydrotreating unit, an aromatics saturation rate of feedstock is controlled to less than or equal to 58%; optionally, the aromatics saturation rate of feedstock=100%*(the content of aromatics in feedstock−the content of aromatics in reaction effluent of hydrotreating unit)/the content of aromatics in feedstock.

10. The process according to any one of previous technical solutions, which is characterized in that the first hydrogenation cracking unit has the following reaction conditions: hydrogen partial pressure: 3.0 MPa-20.0 MPa, e.g. 8.0 MPa-17.0 MPa, reaction temperature: 280° C.-430° C., e.g. 280° C.-400° C., or 340-430° C., LHSV: 0.5 $h^{-1}$-6 $h^{-1}$, e.g. 0.7 $h^{-1}$-3.0 $h^{-1}$, $H_2$/oil ratio by volume: 300-2000, e.g. 800-1500.

11. The process according to any one of previous technical solutions, which is characterized in that the conversion of >350° C. fraction in the first hydrogenation cracking unit is controlled to the following range:

from 100*(Awt %/the mass fraction of >350° C. fraction in gas oil feedstock) to 100*(Bwt %/the mass fraction of >350° C. fraction in gas oil feedstock), wherein, A is the mass fraction of paraffins in gas oil feedstock, B is the sum of mass fractions of paraffins, monocycloparaffins, and monocyclic aromatics in gas oil feedstock, wherein, the conversion of >350° C. fraction in the first hydrogenation cracking unit=100%*(the mass fraction of >350° C. fraction in gas oil feedstock−the mass fraction of >350° C. fraction in the reaction product of the first hydrogenation cracking unit)/the mass fraction of >350° C. fraction in gas oil feedstock.

12. The process according to any one of previous technical solutions, which is characterized in that the hydrogenation cracking catalyst I comprises a support and an active metal component, the support comprises heat-resistant inorganic oxides and molecular sieves, the heat-resistant inorganic oxide is one or more of silica and alumina, the active metal component is at least two metal components of Group VIB metals and Group VIII metals; based on the whole of hydrogenation cracking catalyst I, as oxide, Group VIB metal comprises 10 wt %-35 wt %, Group VIII metal comprises 2 wt %-8 wt %;

based on the support, the molecular sieve comprises 10 wt %-75 wt %, preferably, 20 wt %-60 wt %, e.g. 35 wt %-45 wt %, the balance is the heat-resistant inorganic oxide:

the molecular sieve has a silica/alumina molar ratio of 20-50, a pore size of 0.4 nm-0.58 nm, preferably, a specific surface area of 200 $m^2$/g-400 $m^2$/g.

13. The process according to technical solution 12, which is characterized in that the molecular sieve is one or more of molecular sieves ZSM-5, ZSM-11, ZSM-12, ZSM-22, ZSM-23, ZSM-48, ZSM-50, IM-5, MCM-22, and EU-1, preferably ZSM-5.

14. The process according to any one of previous technical solutions, which is characterized in that the second hydrogenation cracking unit has the following reaction conditions:

hydrogen partial pressure: 3.0 MPa-20.0 MPa, e.g. 8.0 MPa-17.0 MPa, reaction temperature: 280° C.-430° C., e.g., 280-400° C., LHSV: 0.5 $h^{-1}$-6 $h^{-1}$, e.g. 0.7 $h^{-1}$-3.0 $h^{-1}$, $H_2$/oil ratio by volume: 300-2000, e.g. 800-1800.

15. The process according to any one of previous technical solutions, which is characterized in that the conversion of >350° C. fraction in the second hydrogenation cracking unit is controlled to a range of 5%-80%, wherein, the conversion of >350° C. fraction in the second hydrogenation cracking unit=100%*(the mass fraction of >350° C. fraction of heavy fraction I–the mass fraction of >350° C. fraction of heavy fraction II)/the mass fraction of >350° C. fraction of heavy fraction I.

16. The process according to any one of previous technical solutions, which is characterized in that the hydrogenation cracking catalyst II comprises a support and an active metal component, said support comprises heat-resistant inorganic oxides and Y-type molecular sieves, the heat-resistant inorganic oxide is one or more of silica, alumina, and titania, the active metal component is at least two metal components of Group VIB metals and Group VIII metals; based on the whole of hydrogenation cracking catalyst II, as oxide, Group VIB metal comprises 10 wt %-35 wt %, Group VIII metal comprises 2 wt %-8 wt %;

based on the support, the Y-type molecular sieve comprises 5 wt %-55 wt %, the balance is the heat-resistant inorganic oxide;

optionally, in the case that the second hydrogenation cracking unit is loaded with the hydrogenation cracking catalyst, the reaction temperature of second hydrogenation cracking unit is 0-30° C. higher than the temperature of the first hydrogenation cracking unit.

17. The process according to any one of previous technical solutions, which is characterized in that the hydrotreating catalyst is a supported catalyst, the support is alumina or silica-alumina, the active metal component is at least one selected from Group VIB metals and/or at least one selected from Group VIII metals, the Group VIII metal is Ni and/or Co, the Group VIB metal is Mo and/or W, based on the total weight of the hydrotreating catalyst, as oxide, the content of Group VIII metal(s) is 1-15 wt %, the content of Group VIB metal(s) is 5-40 wt %;

optionally, in the case that the second hydrogenation cracking unit is loaded with the hydrotreating catalyst, the reaction temperature of second hydrogenation cracking unit is 0-35° C. lower than the temperature of the first hydrogenation cracking unit.

18. The process according to any one of previous technical solutions, which is characterized in that the resulting reaction effluent of the first hydrogenation cracking unit is separated to produce light fraction I and heavy fraction I, light fraction I has an initial boiling point of 20° C.-30° C., light fraction I and heavy fraction I have a cutting point of 65° C.-120° C., preferably 65-105° C.; the mass fraction of paraffins in the light fraction I is at least 85%.

19. The process according to any one of previous technical solutions, which is characterized in that the resulting reaction effluent of the first hydrogenation cracking unit is separated to produce light fraction I and heavy fraction I, light fraction I has an initial boiling point of 20° C.-30° C., light fraction I and middle fraction I have a cutting point of 65° C.-120° C., preferably 65-105° C., middle fraction I and heavy fraction I have a cutting point of 160-180° C., the light fraction I is rich in paraffins, preferably the mass fraction of paraffins in the light fraction I is at least 85%.

20. The process according to any one of previous technical solutions, which is characterized in that light fraction II has an initial boiling point of 65° C.-100° C., light fraction II and heavy fraction II have a cutting point of 155-180° C.;

the light fraction II has a total mass fraction of naphthenes and aromatics of at least 58%, the mass fraction of naphthenes in the >350° C. fraction of heavy fraction II is at least 50%.

21. The process according to any one of previous technical solutions, which is characterized in that the mass content of aromatics+naphthenes in the hydrocarbons of the gas oil feedstock is greater than 70%, e.g. 70%-90%, 75%-90%, 80%-90%, 85-90%, 75%-85%, 80%-85%.

22. The process according to any one of previous technical solutions, which is characterized in that the process condition parameters of reaction temperature, LHSV, $H_2$/oil ratio and reaction pressure of the first hydrogenation cracking unit are adjusted and controlled so that the conversion of paraffins in the feedstock is 56%-95%, the total conversion of naphthenes and aromatics is 10%-65%.

23. The process according to any one of previous technical solutions, which is characterized in that a stream that is sent to the first hydrogenation cracking unit for treatment has an aromatics mass content of 10 wt %-40 wt %, and on the basis that the content of aromatics is 100 wt %, the content of monocyclic aromatics is 60 wt %-85 wt %.

24. The process according to any one of previous technical solutions, which is characterized in that a stream that is sent to the second hydrogenation cracking unit for treatment has a total mass content of naphthenes and aromatics of 75 wt %-90 wt %.

25. The process according to any one of previous technical solutions, which is characterized in that in the first hydrogenation cracking unit, the hydrogenation cracking catalyst I comprises a support and an active metal component, the support comprises heat-resistant inorganic oxides and molecular sieves, based on the support, the molecular sieve comprises 10 wt %-75 wt %, preferably, 20 wt %-60 wt %, e.g. 35 wt %-45 wt %, the balance is the heat-resistant inorganic oxide; the molecular sieve has a silica/alumina molar ratio of 20-50, a pore size of 0.4 nm-0.58 nm, preferably, a specific surface area of 200 $m^2/g$-400 $m^2/g$.

26. The process according to any one of previous technical solutions, which is characterized in that in the first hydrogenation cracking unit, a fraction cutting is performed at 65° C.-120° C., preferably 65-105° C., and optionally a fraction cutting is performed at 160° C.-180° C.

27. The process according to any one of previous technical solutions, which is characterized in that the gas oil feedstock has an initial boiling point of 300-350° C., a final boiling point of 520-650° C., and a density at 20° C. of 0.890 $g/cm^3$-0.940 $g/cm^3$; the mass content of aromatics+naphthenes in the hydrocarbons of the gas oil feedstock is greater than 70%, e.g. 70%-90%, 75%-90%, 80%-90%, 85-90%, 75%-85%, 80%-85%; and the gas oil feedstock is one or more of atmospheric gas oil, vacuum gas oil, hydrogenated gas oil, coker gas oil, catalytic cracking heavy cycle oil, and deasphalted oil.

28. The process according to any one of previous technical solutions, which is characterized in that in the first hydrogenation cracking unit, one or more process condition parameters of reaction temperature, LHSV, $H_2$/oil ratio and reaction pressure, preferably reaction temperature and LHSV, of the first hydrogenation cracking unit are adjusted and controlled so that the conversion of paraffins in the feedstock is 56%-95%, the total conversion of naphthenes and aromatics is 10%-65%, wherein the conversion of paraffins=(the content of paraffins in the feedstock−the content of paraffins in the >350° C. fraction of the product of the first hydrogenation cracking unit*the mass fraction of the >350° C. fraction in the product of the first hydrogenation cracking unit)/the content of paraffins in the feedstock;

the total conversion of naphthenes and aromatics=(the total content of naphthenes and aromatics in the feedstock−the total content of naphthenes and aromatics in >350° C. fraction of the product of the first hydrogenation cracking unit*the mass fraction of the >350° C. fraction in the product of the first hydrogenation cracking unit)/the total content of naphthenes and aromatics in the feedstock.

29. The process according to any one of previous technical solutions, which is characterized in that for the aromatics saturation rate of feedstock, and for the conversion of >350° C. fraction, the conversion of paraffins, and the conversion of naphthenes+aromatic in the first hydrogenation cracking unit, operation parameters are determined as follows, to control the saturation rate/conversion:

(1) setting a target difference between the actual saturation rate/conversion and the target saturation rate/conversion, such as 20%, (2) pre-determining a group of operation parameters, including hydrogen partial pressure or reaction pressure, reaction temperature, LHSV, and $H_2$/oil ratio by volume, and determining an actual saturation rate/conversion under the pre-determined operation parameters, (3) when the absolute value of the difference between the actual saturation rate/conversion and the target saturation rate/conversion is greater than the target difference, using a certain step size as the initial step size and increasing or decreasing the operation temperature until the absolute value of the difference between the actual saturation rate/conversion and the target saturation rate/conversion is less than the target difference;

reducing the step size if the operation temperature is increased or decreased with this step size and the absolute value of the difference between the actual saturation rate/conversion and the target saturation rate/conversion being less than the target difference can never be achieved within the operation temperature range, and starting from the predetermined temperature, increasing or decreasing the operation temperature until the absolute value of the difference between the actual saturation rate/conversion and the target saturation rate/conversion is less than the target difference;

(4) using the temperature determined in step (3) as the predetermined temperature in step (4), using a step size smaller than the initial step size in step (3) as the initial step size in step (4), and using a target difference smaller than the target difference in step (3) as the target difference in step (4), repeating step (3);

(5) performing step (3) or (4), or repeating step (4) until the desired absolute value of the difference between the actual saturation rate/conversion and the target saturation rate/conversion is reached, thereby determining the operation temperature and achieving the control of the saturation rate/conversion;

re-determining the operation parameters of step (2) if the absolute value of the difference between the actual saturation rate/conversion and the target saturation rate/conversion being less than the target difference can never be achieved, or if the desired absolute value of the difference between the actual saturation rate/conversion and the target saturation rate/conversion can never be achieved, for example, increasing or decreasing one or more of hydrogen partial pressure or reaction pressure, LHSV, and $H_2$/oil ratio by volume by a factor of 10%, 9%, 8%, 7%, 6%, 5%, 4%, 3%, 2%, 1% or a higher or lower value, and repeating step (2).

30. The process according to any one of previous technical solutions, which is characterized in that for the conversion of >350° C. fraction, the conversion of paraffins, and the conversion of naphthenes+aromatic in the first hydrogenation cracking unit, operation parameters are determined as follows, to control the conversions:

a linear relationship between the reaction temperature of the first hydrogenation cracking unit and the conversion of >350° C. fraction, the conversion of paraffins, and the conversion of naphthenes+aromatic in the first hydrogenation cracking unit is determined, which satisfies:

$$y_{conversion}=a^*\text{reaction temperature value}-B,$$

wherein the range of a is 0.10-4.0, and the range of B is 30-300;

for the conversion of >350° C. fraction in the first hydrogenation cracking unit in the linear relationship formula, the range of parameter a is 0.3-3.0, and the range of parameter B is 100-300;

for the conversion of paraffins, in the linear relationship formula, the range of parameter a is 0.2-2.0, and the range of parameter B is 40-150;

for the conversion of naphthenes+aromatic, in the linear relationship formula, the range of parameter a is 0.25-2.5, and the range of parameter B is 60-250;

the operation temperature is determined with the above conversion linear relationship formula.

31. A system for performing the process according to any one of the preceding technical solutions, comprising a hydrotreating unit, a first hydrogenation cracking unit, and a second hydrogenation cracking unit;

the hydrotreating unit is provided with a gas oil feedstock inlet, a hydrogen gas inlet, and a reaction effluent outlet, in the hydrotreating unit are successively loaded a hydrogenation protection agent, optionally a hydrodemetallization catalyst, and a hydrorefining catalyst;

the first hydrogenation cracking unit is provided with a first hydrogenation cracking system and a first separation system, in the first hydrogenation cracking system is loaded a hydrogenation cracking catalyst I, the first hydrogenation cracking system is provided with an inlet for the reaction effluent of the hydrotreating unit, which is communicated with the reaction effluent outlet of the hydrotreating unit, a reaction effluent outlet of the first hydrogenation cracking system is communicated with an inlet of the first separation system, the first separation system is at least provided with a first hydrogen-rich gas outlet, a light fraction I outlet and a heavy fraction I outlet;

the second hydrogenation cracking unit is provided with a second hydrogenation cracking system and a second separation system, in the second hydrogenation cracking system are loaded a hydrogenation cracking catalyst II and/or a hydrotreating catalyst, the second hydrogenation cracking system is provided with an inlet for heavy fraction I, which is communicated with the heavy fraction I outlet of the first separation system, a reaction effluent outlet of the second hydrogenation cracking system is communicated with an inlet for the second separation system, the second separation system is at least provided with a second hydrogen-rich gas outlet, a light fraction II outlet, and a heavy fraction II outlet.

32. The apparatus according to any one of the preceding technical solutions, wherein in the first hydrogenation cracking unit, the hydrogenation cracking catalyst I comprises a support and an active metal component, the support comprises heat-resistant inorganic oxides and molecular sieves, based on the support, the molecular sieve comprises 10 wt %-75 wt %, preferably, 20 wt %-60 wt %, e.g. 35 wt %-45 wt %, the balance is the heat-resistant inorganic oxide; the molecular sieve has a silica/alumina molar ratio of 20-50, and a pore size of 0.4 nm-0.58 nm;

in the first hydrogenation cracking unit, a control device is provided to control a fraction cutting to be performed at 65° C.-120° C., preferably 65-105° C., and optionally a control device is provided to control a fraction cutting to be performed at 160-180° C.

The present invention will be further described below with reference to the examples, but this does not limit the present invention in any way.

In the Examples and Comparative Examples, the hydrocarbon composition data of gas oil feedstock are obtained through SH/T 0659 "Standard test method for hydrocarbon types analysis of gas-oil saturates fractions by high ionizing voltage mass spectrometry".

The hydrocarbon composition data of light fraction I and light fraction II are obtained through SH/T 0714 "Standard test method for detailed analysis of petroleum naphthas through n-nonane by capillary gas chromatography".

The hydrocarbon composition data of >350° C. fraction of heavy fraction I, and >350° C. fraction of heavy fraction II are obtained through SH/T 0659 "Standard test method for hydrocarbon types analysis of gas-oil saturates fractions by high ionizing voltage mass spectrometry".

Table 1 lists the properties of the gas oil feedstock used in the present invention.

Table 2 and Table 3 list the physical and chemical properties of each catalyst used in Examples and Comparative Examples of the present invention. The catalysts with trade names are all produced by the Sinopec Catalyst Branch, and the catalysts without trade names are all obtained with preparation methods for conventional supported hydrogenation catalysts used in fixed beds.

It can be seen from Table 1, the mass fraction (A) of paraffins in the gas oil feedstock used in the present invention is 20.4, the sum (B) of mass fractions of paraffins, monocycloparaffins, monocyclic aromatics in the gas oil feedstock is 49.3.

According to the present invention, the conversion of >350° C. fraction in the first hydrogenation cracking unit is controlled to the following range:

from 100*(Awt %/the mass fraction of >350° C. fraction in gas oil feedstock) to 100*(Bwt %/the mass fraction of >350° C. fraction in gas oil feedstock), wherein, A is the mass fraction of paraffins in gas oil feedstock, B is the sum of mass fractions of paraffins, monocycloparaffins, and monocyclic aromatics in gas oil feedstock.

Then, the conversion of >350° C. fraction in the first hydrogenation cracking unit should be controlled in the range of 22.7-54.7%.

In Examples and Comparative Examples of the present invention, the yield of low-carbon light hydrocarbons, the yield of light fraction I, the yield of light fraction II, and the yield of heavy fraction II are all calculated based on the gas oil feedstock.

In Examples and Comparative Examples of the present invention, the mass fraction of >350° C. fraction of heavy fraction I was based on the mass of heavy fraction I; the mass fraction of (280-370° C.) fraction of heavy fraction II was based on the mass of heavy fraction II; the mass fraction of >350° C. fraction of heavy fraction IIwas based on the mass of heavy fraction II.

Example 1

A gas oil feedstock was reacted by successively contacting a hydrogenation protection agent (protection agent), a hydrodemetallization catalyst (demetallization agent), and a hydrorefining catalyst (refining catalyst) in a hydrotreating unit. The resulting reaction effluent was sent to the first hydrogenation cracking unit, and reacted by contacting a ZSM-5 molecular sieve-containing hydrogenation cracking catalyst I (cracking agent 1). The resulting reaction effluent was separated to produce light fraction I and heavy fraction I. The resulting heavy fraction I was sent to a second hydrogenation cracking unit, and reacted by contacting a hydrotreating catalyst (treating agent). The resulting reaction effluent was separated to produce light fraction II and heavy fraction II. The specific reaction conditions and product properties are shown in Table 4.

In the reaction process of this example, the aromatics saturation rate in the hydrotreating unit was controlled to 50%, the conversion of >350° C. fraction in the first hydrogenation cracking unit was controlled to 49.4%, and the conversion of >350° C. fraction in the second hydrogenation cracking unit was controlled to 20%.

It can be seen from Table 4 that the obtained light fraction I had a content of paraffins of 92.7 wt %, and could be used as a high-quality feedstock for producing ethylene by steam cracking; the obtained light fraction II had a content of naphthenes+aromatics of 62.0 wt %, and could be used as a high-quality reforming feedstock; the >350° C. fraction of the obtained heavy fraction I had a content of naphthenes+aromatics of 82.8 wt %; the (280-370° C.) fraction of the obtained heavy fraction II had a condensation point of <−50° C., a kinematic viscosity @40° C. of 6.944 $mm^2/s$, and a polycyclic aromatics (PCA) content of less than 3.0%, and could be used as transformer oil; the >350° C. fraction of the obtained heavy fraction II had a content of naphthenes+aromatics of 77.8 wt %, and a condensation point of −38° C., and could be used as a high-quality naphthenic speciality oil, such as refrigerator oil.

Comparative Example 1 and Comparative Example 2

Comparative Example 1 and Comparative Example 2 used the same process as Example 1 except that, in Comparative Example 1, the first hydrogenation cracking unit was loaded with a Y-type molecular sieve-containing hydrogenation cracking catalyst (cracking agent 2); in Comparative Example 2, the first hydrogenation cracking unit was loaded with β-type molecular sieve-containing hydrogenation cracking catalyst (cracking agent 3). The reactions were carried out while controlling the aromatics saturation rate in the hydrotreating unit, the conversion of >350° C. fraction in the first hydrogenation cracking unit and the conversion of >350° C. fraction in the second hydrogenation cracking unit to the conditions similar to those in Example 1. The specific reaction conditions and product properties are shown in Table 4.

It can be seen from Table 4 that the light fraction I products of Comparative Example 1 and Comparative Example 2 had the contents of paraffins of 54.9 wt % and 47.9 wt % respectively; the light fraction II products had the contents of naphthenes+aromatics of 60.1 wt % and 58.6 wt % respectively, the >350° C. fractions of the heavy fraction I products had the contents of naphthenes+aromatics of 59.0 wt % and 72.4 wt % respectively, the >350° C. fractions of the heavy fraction II products had the contents of naphthenes+aromatics of 54.0 wt % and 68.2 wt % respectively, and the condensation points of +28° C. and +8° C. respectively.

The above results showed that by using traditional hydrocracking implementations with the Y-type or β-type molecular sieve catalyst, it was difficult to achieve efficient and selective conversion of feedstocks into paraffins and naphthenes. However, using the process of the present invention can realize the directional conversion of gas oil feedstocks according to the chain structure and the ring structure, thereby achieving the production of high-quality chemical raw materials and high-value-added naphthenic speciality oil.

Example 2

A gas oil feedstock was reacted by successively contacting a hydrogenation protection agent (protection agent), a hydrodemetallization catalyst (demetallization agent), and a hydrorefining catalyst (refining catalyst) in a hydrotreating unit. The resulting reaction effluent was sent to the first hydrogenation cracking unit, and reacted by contacting a ZSM-5 molecular sieve-containing hydrogenation cracking catalyst I (cracking agent 1). The resulting reaction effluent was separated to produce light fraction I, middle fraction I and heavy fraction I. The resulting middle fraction I was sent to a fractionation column of a second hydrogenation cracking unit for fractionation. The resulting heavy fraction I was sent to the second hydrogenation cracking unit, and reacted by contacting a hydrotreating catalyst (treating agent). The resulting reaction effluent was separated to produce light fraction II and heavy fraction II. The specific reaction conditions and product properties are shown in Table 5.

In the reaction process of this example, the aromatics saturation rate in the hydrotreating unit was controlled to 38.6%, the conversion of >350° C. fraction in the first hydrogenation cracking unit was controlled to 47.1%, and the conversion of >350° C. fraction in the second hydrogenation cracking unit was controlled to 5%.

It can be seen from Table 5 that the obtained light fraction I had a content of paraffins of 91.74 wt %, and could be used as a high-quality feedstock for producing ethylene by steam cracking; the obtained light fraction II had a content of naphthenes+aromatics of 61.55 wt %, and could be used as a high-quality reforming feedstock; the >350° C. fraction of the obtained heavy fraction I had a content of naphthenes+aromatics of 84.7 wt %; the (280-370° C.) fraction of the obtained heavy fraction II had a condensation point of <−50° C., a kinematic viscosity@40° C. of 7.790 $mm^2/s$, and a polycyclic aromatics (PCA) content of less than 3.0%, and could be used as transformer oil; the >350° C. fraction of the obtained heavy fraction II had a content of naphthenes+aromatics of 81.7 wt %, and a condensation point of −38° C., and could be used as a high-quality naphthenic speciality oil, such as refrigerator oil.

Example 3

The same process as that of Example 2 was used. The specific reaction conditions and product properties are shown in Table 5.

In the reaction process of this example, the aromatics saturation rate in the hydrotreating unit was controlled to 56.4%, the conversion of >350° C. fraction in the first hydrogenation cracking unit was controlled to 44.4%, and the conversion of >350° C. fraction in the second hydrogenation cracking unit was controlled to 5%.

It can be seen from Table 5 that the obtained light fraction I had a content of paraffins of 90.18 wt %, and could be used as a high-quality feedstock for producing ethylene by steam cracking; the obtained light fraction II had a content of naphthenes+aromatics of 60.82 wt %, and could be used as a high-quality reforming feedstock; the >350° C. fraction of the obtained heavy fraction I had a content of naphthenes+aromatics of 83.5 wt %; the (280-370° C.) fraction of the obtained heavy fraction II had a condensation point of <−50° C., a kinematic viscosity@40° C. of 7.065 $mm^2/s$, and a polycyclic aromatics (PCA) content of less than 3.0%, and could be used as transformer oil; the >350° C. fraction of the obtained heavy fraction II had a content of naphthenes+aromatics of 80.5 wt %, and a condensation point of −38° C., and could be used as a high-quality naphthenic speciality oil, such as refrigerator oil.

Comparative Example 3

The same process as that of Example 2 was used, except that the aromatics saturation rate in the hydrotreating unit was controlled to 59.2%. The specific reaction conditions and product properties are shown in Table 5.

It can be seen from Table 5 that the obtained light fraction I had a content of paraffins of 86.08 wt %, the obtained light fraction II had a content of naphthenes+aromatics of 56.42 wt %; the >350° C. fraction of the obtained heavy fraction I had a content of naphthenes+aromatics of 81.3 wt %, the >350° C. fraction of the obtained heavy fraction II had a content of naphthenes+aromatics of 79.8 wt %, and a condensation point of −38° C.

The above results showed that this Comparative Example did not adopt the preferred range of the present invention. Increasing the aromatics saturation rate in the hydrotreating unit would lead to an increase in the ring-opening cracking reaction of naphthenes in the first hydrogenation cracking unit, which would have an adverse influence on the reaction effect of the directional conversion of gas oil feedstock according to the chain structure and the ring structure.

Example 4

A gas oil feedstock was reacted by successively contacting a hydrogenation protection agent (protection agent), a hydrodemetallization catalyst (demetallization agent), and a hydrorefining catalyst (refining catalyst) in a hydrotreating unit. The resulting reaction effluent was sent to the first hydrogenation cracking unit, and reacted by contacting a ZSM-5 molecular sieve-containing hydrogenation cracking catalyst I (cracking agent 1). The resulting reaction effluent was separated to produce light fraction I and heavy fraction I. The resulting heavy fraction I was sent to a second hydrogenation cracking unit, and reacted by contacting a hydrogenation cracking catalyst II (cracking agent 4). The resulting reaction effluent was separated to produce light fraction II and heavy fraction II. The specific reaction conditions and product properties are shown in Table 6.

In the reaction process of this example, the aromatics saturation rate in the hydrotreating unit was controlled to 38.6%, the conversion of >350° C. fraction in the first hydrogenation cracking unit was controlled to 47.1%, and the conversion of >350° C. fraction in the second hydrogenation cracking unit was controlled to 56.25%.

It can be seen from Table 6 that the obtained light fraction I had a content of paraffins of 91.74 wt %, and could be used as a high-quality feedstock for producing ethylene by steam cracking; the obtained light fraction II had a content of naphthenes+aromatics of 64.37 wt %, and could be used as a high-quality reforming feedstock; the >350° C. fraction of the obtained heavy fraction I had a content of naphthenes+aromatics of 84.7 wt %; the (280-370° C.) fraction of the obtained heavy fraction II had a condensation point of <−50° C., a kinematic viscosity a 40° C. of 7.801 $mm^2/s$, and a polycyclic aromatics (PCA) content of less than 3.0%, and could be used as transformer oil; the >350° C. fraction of the obtained heavy fraction II had a content of naphthenes+aromatics of 65.1 wt %, and a condensation point of −38° C., and could be used as a high-quality naphthenic speciality oil, such as refrigerator oil.

Example 5

The same process as that of Example 4 was used. The specific reaction conditions and product properties are shown in Table 6.

In the reaction process of this example, the aromatics saturation rate in the hydrotreating unit was controlled to 38.6%, the conversion of >350° C. fraction in the first hydrogenation cracking unit was controlled to 47.1%, and the conversion of >350° C. fraction in the second hydrogenation cracking unit was controlled to 72.4%.

It can be seen from Table 6 that the obtained light fraction I had a content of paraffins of 91.74 wt %, and could be used as a high-quality feedstock for producing ethylene by steam cracking; the obtained light fraction II had a content of naphthenes+aromatics of 59.64 wt %, and could be used as a high-quality reforming feedstock; the >350° C. fraction of the obtained heavy fraction I had a content of naphthenes+aromatics of 84.7 wt %; the (280-370° C.) fraction of the obtained heavy fraction II had a condensation point of <−50° C., a kinematic viscosity (40° C. of 6.725 $mm^2/s$, and a polycyclic aromatics (PCA) content of less than 3.0%, and could be used as transformer oil; the >350° C. fraction of the obtained heavy fraction II had a content of naphthenes+aromatics of 63.0 wt %, and a condensation point of −35° C., and could be used as a high-quality naphthenic speciality oil, such as refrigerator oil.

Comparative Example 4

The same process as that of Example 4 was used, except that in the second hydrogenation cracking unit, a higher conversion of >350° C. fraction was used (88.5%). The specific reaction conditions and product properties are shown in Table 6.

It can be seen from Table 6 that with the process of this Comparative Example, the content of paraffins in the light fraction I product was also 91.74 wt %; but the content of naphthenes+aromatics in the light fraction II product was only 55.9 wt %, and the >350° C. fraction of the heavy fraction II product had the content of naphthenes+aromatics of 43.9 wt % and a condensation point of −30.0° C. The properties of the product could not meet the quality requirements of high-quality naphthenic speciality oil.

The above results showed that controlling the second hydrogenation cracking unit to an excessively high conversion of >350° C. fraction would not only reduce the content of naphthenes and aromatics in the light fraction II, but also cause the quality index of the heavy fraction II product to fail to meet the quality requirements of naphthenic specialty oil.

Comparative Example 5

The same process as that of Example 4 was used, except that in the first hydrogenation cracking unit, a higher conversion of >350° C. fraction was used (65%). The specific reaction conditions and product properties are shown in Table 6.

It can be seen from Table 6 that with the process of this Comparative Example, the content of paraffins in the light fraction I product was 88.25 wt %; the content of naphthenes+aromatics in the light fraction II product was 61.36 wt %, the >350° C. fraction of the obtained heavy fraction I had a content of naphthenes+aromatics of 80.4 wt %, the >350° C. fraction of the obtained heavy fraction II had a content of naphthenes+aromatics of 59.9 wt % and a condensation point of −45° C. It should be noted that although controlling a higher conversion in the first hydrogenation cracking unit could also obtain products with qualified properties, when the conversion in the first hydrogenation cracking unit was too high, the mass fraction of the low carbon light hydrocarbons (C3+C4) product was as high as 18.5 wt %, the chemical hydrogen consumption of the reaction was too high, and the target product distribution was unreasonable.

The above results showed that the reaction process was uneconomical when a too high conversion of >350° C. fraction was controlled in the first hydrogenation cracking unit.

Example 6, Comparative Examples 6-7

A gas oil feedstock was reacted by successively contacting a hydrogenation protection agent (protection agent), a hydrodemetallization catalyst (demetallization agent), and a hydrorefining catalyst (refining catalyst) in a hydrotreating unit, the resulting reaction effluent was sent to the first hydrogenation cracking unit, and reacted by contacting a ZSM-5 molecular sieve-containing hydrogenation cracking catalyst I (cracking agents 5-7). The resulting reaction effluent was separated to produce light fraction I and heavy fraction I. The resulting heavy fraction I was sent to a second hydrogenation cracking unit, and reacted by contacting a hydrotreating catalyst (treating agent). The resulting reaction effluent was separated to produce light fraction II and heavy fraction II. The specific reaction conditions and product properties are shown in Table 7.

If the molecular sieve content was too low, the conversion of paraffins would be insufficient. However, if the molecular sieve content was too low or too high, there would be problems with high ring-opening rates of naphthenes and aromatics. If the molecular sieve content was too high, there would also be a problem of high content of light hydrocarbons in the by-products.

Example 7

The same process as that of Example 6 was used, except that other molecular sieves such as IM-5 and ZSM-48 were used instead of ZSM-5 to obtain products with qualified properties.

Table 8 lists the product quality indicators of transformer oil and refrigerator oil.

TABLE 1

| Item | Intermediate-base VGO feedstock |
|---|---|
| Density (20° C.)/(g/cm$^3$) | 0.9091 |
| Sulfur/wt % | 2.19 |
| Nitrogen/μg · g$^{-1}$ | 703 |
| Distillation range/° C. | |
| IBP/50%/95% | 305/415/482 |
| >350° C. fraction mass fraction, % | 90.0 |
| hydrocarbon composition/mass % | |
| paraffins | 20.4 |
| monocycloparaffins | 7.0 |
| dicycloparaffins | 10.3 |
| tricycloparaffins | 7 |
| tetracycloparaffins | 3.9 |
| pentacycloparaffins | 1.3 |
| hexacycloparaffins | 0.1 |
| total naphthenes | 29.6 |
| monocyclic aromatics | 21.9 |
| bicyclic aromatics | 11.5 |
| tricyclic aromatics | 3.9 |
| tetracyclic aromatics | 1.8 |
| pentacyclic aromatics | 0.5 |
| total thiophene + unidentified aromatics | 9.4 |
| total aromatics | 50.0 |
| total weight | 100.0 |
| A (mass fraction of paraffins in gas oil feedstock) | 20.4 |
| B (sum of mass fractions of paraffins, monocycloparaffins and monocyclic aromatics in gas oil feedstock) | 49.3 |

TABLE 2

| Item | protection agent | demetallization agent | refining catalyst | treating agent |
|---|---|---|---|---|
| Brand name | RG-30A/B | RAM-100 | RJW-3 | RN-32V |
| Metal | Ni/Mo | Ni/Mo | Ni/Mo/W | Ni/Mo/W |
| NiO, wt % | 0.5-1.5 | ≥1 | ≥3 | ≥2.4 |
| $MoO_3$, wt % | 2-6 | ≥6 | ≥1 | ≥2.3 |
| $WO_3$, wt % | / | / | ≥26 | ≥23.0 |
| support | alumina | alumina | alumina | alumina and silica-alumina |

TABLE 3

| Item | cracking agent 1 | cracking agent 2 | cracking agent 3 | cracking agent 4 | cracking agent 5 | cracking agent 6 | cracking agent 7 |
|---|---|---|---|---|---|---|---|
| Metal | NiW | NiW | NiW | NiMo | NiW | NiW | NiW |
| NiO, wt % | ≥4 | ≥3 | ≥2.5 | ≥4.5 | ≥4 | ≥4 | ≥4 |
| $MoO_3$, wt % | / | / | / | ≥15.5 | / | / | / |
| $WO_3$, wt % | ≥18 | ≥23 | ≥25 | / | ≥18 | ≥18 | ≥18 |
| molecular sieve type | ZSM-5 | Y | β | Y | ZSM-5 | ZSM-5 | ZSM-5 |
| molecular sieve content, wt % | 35 | 15 | 15 | 30 | 45 | 5 | 80 |
| pore size/nm | 0.5 | 0.7 | 0.8 | 0.7 | 0.5 | 0.5 | 0.5 |

TABLE 4

| Item | Example 1 | Comparative Example 1 | Comparative Example 2 |
|---|---|---|---|
| feedstock | Intermediate-base VGO feedstock | | |
| catalyst | | | |
| hydrotreating unit (catalyst loading volume ratio) | VRG-30A/VRG-30B/VRAM-10/VRJW-3 = 5:8:8:77 | | |
| first hydrogenation cracking unit | cracking agent 1 | cracking agent 2 | cracking agent 3 |
| second hydrogenation cracking unit | treating agent | treating agent | treating agent |
| process condition parameters | | | |
| hydrogen partial pressure of hydrotreating unit/MPa | 14.0 | 14.0 | 14.0 |
| hydrogen partial pressure of first hydrogenation cracking unit/MPa | 14.0 | 14.0 | 14.0 |
| hydrogen partial pressure of second hydrogenation cracking unit/MPa | 14.0 | 14.0 | 14.0 |
| reaction temperature of hydrotreating unit/° C. | 365 | 365 | 365 |
| reaction temperature of first hydrogenation cracking unit/° C. | 375 | 370 | 370 |
| reaction temperature of second hydrogenation cracking unit/° C. | 375 | 375 | 375 |
| protection agent LHSV/$h^{-1}$ | 12.7 | 12.7 | 12.7 |
| demetallization agent LHSV/$h^{-1}$ | 22.3 | 22.3 | 22.3 |
| refining catalyst LHSV/$h^{-1}$ | 1.0 | 1.0 | 1.0 |
| LHSV of first hydrogenation cracking unit/$h^{-1}$ | 1.4 | 1.4 | 1.4 |
| LHSV of second hydrogenation cracking unit/$h^{-1}$ | 3.0 | 3.0 | 3.0 |
| $H_2$/oil ratio by volume of hydrotreating unit | 800 | 800 | 800 |
| $H_2$/oil ratio by volume of first hydrogenation cracking unit | 1200 | 1200 | 1200 |
| $H_2$/oil ratio by volume of second hydrogenation cracking unit | 1200 | 1200 | 1200 |
| nitrogen content of liquid phase product in hydrotreating unit/(μg/g) | 7.2 | 10.0 | 9.0 |
| aromatics saturation rate of feedstock in hydrotreating unit/% | 50 | 50 | 50 |
| stream sent to first hydrogenation cracking unit for treatment | | | |
| aromatics mass content(wt %) | 25.0 | 25.0 | 25.0 |
| monocyclic aromatics content(wt %), based on 100 wt % aromatics content | 19.38 | 19.38 | 19.38 |
| stream sent to second hydrogenation cracking unit for treatment | | | |
| sum of naphthenes and aromatics contents(wt %) | 81.03 | 69.61 | 72.52 |
| conversion of >350° C. fraction in first hydrogenation cracking unit/% | 49.4 | 51.8 | 50.7 |
| conversion of paraffins in first hydrogenation cracking unit/% | 66.76 | 10.95 | 40.05 |
| conversion of naphthenes + aromatic in first hydrogenation cracking unit/% | 52.8 | 68.6 | 61.2 |
| conversion of >350° C. fraction in second hydrogenation cracking unit/% | 20 | 21 | 22 |
| product yield and properties | | | |
| low carbon light hydrocarbon yield/weight %(C3 + C4) | 10.7 | 0.8 | 1.4 |
| light fraction I | | | |
| yield/weight % | 8.62 | 3.66 | 3.9 |
| distillation range (IBP-FBP)/° C. | 30-100 | 30-100 | 30-100 |
| hydrocarbon composition (PONA)/% | | | |
| paraffins (n- + iso-paraffins) | 92.7 | 54.9 | 47.9 |
| naphthenes + aromatics | 7.3 | 45.1 | 52.1 |
| heavy fraction I | | | |
| yield/weight % | 80.68 | 95.54 | 94.70 |
| mass fraction of >350° C. fraction in heavy fraction I/% | 56.43 | 45.36 | 46.82 |
| Hydrocarbon compoition of >350° C. | | | |

TABLE 4-continued

| Item | Example 1 | Comparative Example 1 | Comparative Example 2 |
|---|---|---|---|
| fraction of heavy fraction I/% | | | |
| paraffins | 17.2 | 41.0 | 27.6 |
| naphthenes + aromatics | 82.8 | 59.0 | 72.4 |
| light fraction II | | | |
| yield/weight % | 4.0 | 13.40 | 11.80 |
| distillation range (IBP-FBP)/° C. | 65-175 | 65-175 | 65-175 |
| hydrocarbon composition (PONA)/% | | | |
| paraffins (n- + iso-paraffins) | 38.1 | 39.9 | 41.4 |
| naphthenes + aromatics | 62.0 | 60.1 | 58.6 |
| heavy fraction II | | | |
| yield/weight % | 76.68 | 82.14 | 82.90 |
| mass fraction of (280-370° C.) fraction of heavy fraction II/% | 33.92 | 31.45 | 34.27 |
| condensation point/° C. | <−50 | −18 | −36 |
| kinematic viscosity@40° C./($mm^2$/s) | 6.944 | 5.116 | 5.512 |
| polycyclic aromatics (PCA) content/% | <3.0 | <3.0 | <3.0 |
| mass fraction of >350° C. fraction of heavy fraction II/% | 47.60 | 41.64 | 41.62 |
| condensation point of >350° C. fraction of heavy fraction II/° C. | −38 | +28 | +8 |
| kinematic viscosity@100° C. of >350° C. fraction of heavy fraction II/($mm^2$/s) | 5.216 | 4.167 | 4.139 |
| hydrocarbon composition of >350° C. fraction of heavy fraction II/% | | | |
| paraffins | 22.2 | 46.0 | 31.8 |
| naphthenes | 77.5 | 53.8 | 67.8 |
| aromatics | 0.3 | 0.2 | 0.4 |
| polycyclic aromatics (PCA) content,% | <3.0 | <3.0 | <3.0 |

TABLE 5

| Item | Example 2 | Example 3 | Comparative Example 3 |
|---|---|---|---|
| feedstock | Intermediate-base VGO feedstock | | |
| catalyst | | | |
| hydrotreating unit (catalyst loading volume ratio) | VRG-30A/VRG-30B/VRAM-10/VRJW-3 = 5:8:8:77 | | |
| first hydrogenation cracking unit | cracking agent 1 | cracking agent 1 | cracking agent 1 |
| second hydrogenation cracking unit | treating agent | treating agent | treating agent |
| process condition parameters | | | |
| hydrogen partial pressure of hydrotreating unit/MPa | 11.0 | 14.0 | 14.0 |
| hydrogen partial pressure of first hydrogenation cracking unit/MPa | 11.0 | 14.0 | 14.0 |
| hydrogen partial pressure of second hydrogenation cracking unit/MPa | 11.0 | 14.0 | 14.0 |
| reaction temperature of hydrotreating unit/° C. | 365 | 365 | 365 |
| reaction temperature of first hydrogenation cracking unit/° C. | 375 | 365 | 355 |
| reaction temperature of second hydrogenation cracking unit/° C. | 375 | 365 | 355 |
| protection agent LHSV/$h^{-1}$ | 12.7 | 12.7 | 12.7 |
| demetallization agent LHSV/$h^{-1}$ | 22.3 | 22.3 | 22.3 |
| refining catalyst LHSV/$h^{-1}$ | 1.0 | 1.0 | 1.0 |
| LHSV of first hydrogenation cracking unit/$h^{-1}$ | 1.4 | 1.4 | 1.4 |
| LHSV of second hydrogenation cracking unit/$h^{-1}$ | 3.0 | 3.0 | 3.0 |
| $H_2$/oil ratio by volume of hydrotreating | 800 | 800 | 800 |
| $H_2$/oil ratio by volume of first hydrogenation cracking unit | 1200 | 1200 | 1200 |
| $H_2$/oil ratio by volume of second hydrogenation cracking unit | 1200 | 1200 | 1200 |
| nitrogen content of liquid phase product in hydrotreating unit/(μg/g) | 16.92 | 7.2 | 9.0 |
| aromatics saturation rate of feedstock in | 38.6 | 56.4 | 59.2 |

TABLE 5-continued

| Item | Example 2 | Example 3 | Comparative Example 3 |
|---|---|---|---|
| hydrotreating unit/% | | | |
| stream sent to first hydrogenation cracking unit for treatment | | | |
| aromatics mass content(wt %) | 30.7 | 21.8 | 20.4 |
| monocyclic aromatics content(wt %), based on 100 wt % aromatics content | 23.3 | 16.9 | 15.6 |
| stream sent to second hydrogenation cracking unit for treatment | | | |
| sum of naphthenes and aromatics contents(wt %) | 84.47 | 80.03 | 77.72 |
| conversion of >350° C. fraction in first hydrogenation cracking unit/% | 47.1 | 44.4 | 39.8 |
| conversion of paraffins in first hydrogenation cracking unit/% | 66.8 | 60.97 | 54.7 |
| conversion of naphthenes + aromatic in first hydrogenation cracking unit/% | 52.85 | 49.38 | 49.53 |
| conversion of >350° C. fraction in second hydrogenation cracking unit/% | 5 | 5 | 5 |
| product yield and properties | | | |
| low carbon light hydrocarbon yield/weight %(C3 + C4) | 13.26 | 7.26 | 7.24 |
| light fraction I | | | |
| yield/weight % | 6.41 | 5.25 | 3.61 |
| distillation range (IBP-FBP)/° C. | 30-100 | 30-100 | 30-100 |
| hydrocarbon composition (PONA)/% | | | |
| paraffins (n- + iso-paraffins) | 91.74 | 90.18 | 86.08 |
| naphthenes + aromatics | 8.26 | 9.82 | 13.92 |
| heavy fraction I | | | |
| yield/weight % | 80.33 | 87.49 | 89.15 |
| mass fraction of >350° C. fraction in heavy fraction I/% | 59.29 | 57.21 | 60.79 |
| Hydrocarbon compoition of >350° C. fraction of heavy fraction I/% | | | |
| paraffins | 15.3 | 16.5 | 18.7 |
| naphthenes + aromatics | 84.7 | 83.5 | 81.3 |
| light fraction II | | | |
| yield/weight % | 2.61 | 3.63 | 3.06 |
| distillation range (IBP-FBP)/° C. | 65-175 | 65-175 | 65-175 |
| hydrocarbon composition (PONA)/% | | | |
| paraffins (n- + iso-paraffins) | 38.45 | 39.18 | 43.58 |
| naphthenes + aromatics | 61.55 | 60.82 | 56.42 |
| heavy fraction II | | | |
| yield/weight % | 77.72 | 83.86 | 86.09 |
| mass fraction of (280-370° C.) fraction of heavy fraction II/% | 33.35 | 32.1 | 33.25 |
| condensation point/° C. | <−50 | <−50 | <−50 |
| kinematic viscosity@40° C./($mm^2/s$) | 7.790 | 7.065 | 6.254 |
| polycyclic aromatics (PCA) content/% | <3.0 | <3.0 | <3.0 |
| mass fraction of >350° C. fraction of heavy fraction II/% | 58.22 | 56.70 | 59.80 |
| condensation point of >350° C. fraction of heavy fraction II/° C. | −38 | −38 | −38 |
| kinematic viscosity@100° C. of >350° C. fraction of heavy fraction II/($mm^2/s$) | 5.558 | 5.370 | 5.630 |
| hydrocarbon composition of >350° C. fraction of heavy fraction II/% | | | |
| paraffins | 18.3 | 19.5 | 20.2 |
| naphthenes | 76.4 | 79.1 | 75.4 |
| aromatics | 5.3 | 1.4 | 4.4 |
| polycyclic aromatics (PCA) content, % | <3.0 | <3.0 | <3.0 |

TABLE 6

| Item | Example 4 | Example 5 | Comparative Example 4 | Comparative Example 5 |
|---|---|---|---|---|
| feedstock | Intermediate-base VGO feedstock | | | |
| catalyst | | | | |
| hydrotreating unit (catalyst loading volume ratio) | VRG-30A/VRG-30B/VRAM-10/VRJW-3 = 5:8:8:77 | | | |
| first hydrogenation cracking unit | cracking agent 1 | cracking agent 1 | cracking agent 1 | cracking agent 1 |
| second hydrogenation cracking unit | cracking agent 4 | cracking agent 4 | cracking agent 4 | cracking agent 4 |
| process condition parameters | | | | |
| hydrogen partial pressure of hydrotreating unit/MPa | 11.0 | 11.0 | 11.0 | 11.0 |
| hydrogen partial pressure of first hydrogenation cracking unit/MPa | 11.0 | 11.0 | 11.0 | 11.0 |
| hydrogen partial pressure of second hydrogenation cracking unit/MPa | 11.0 | 11.0 | 11.0 | 11.0 |
| reaction temperature of hydrotreating unit/° C. | 365 | 365 | 365 | 365 |
| reaction temperature of first hydrogenation cracking unit/° C. | 375 | 375 | 375 | 400 |
| reaction temperature of second hydrogenation cracking unit/° C. | 353 | 380 | 380 | 353 |
| protection agent LHSV/$h^{-1}$ | 12.7 | 12.7 | 12.7 | 12.7 |
| demetallization agent LHSV/$h^{-1}$ | 22.3 | 22.3 | 22.3 | 22.3 |
| refining catalyst LHSV/$h^{-1}$ | 1.0 | 1.0 | 1.0 | 1.0 |
| LHSV of first hydrogenation cracking unit/$h^{-1}$ | 1.4 | 1.4 | 1.4 | 1.4 |
| LHSV of second hydrogenation cracking unit/$h^{-1}$ | 2.0 | 3.0 | 2.5 | 2.0 |
| $H_2$/oil ratio by volume of hydrotreating | 800 | 800 | 800 | 800 |
| $H_2$/oil ratio by volume of first hydrogenation cracking unit | 1200 | 1200 | 1200 | 1200 |
| $H_2$/oil ratio by volume of second hydrogenation cracking unit | 1200 | 1200 | 1200 | 1200 |
| nitrogen content of liquid phase product in hydrotreating unit/(μg/g) | 16.92 | 16.92 | 16.92 | 16.92 |
| aromatics saturation rate of feedstock in hydrotreating unit/% | 38.6 | 38.6 | 38.6 | 38.6 |
| stream sent to first hydrogenation cracking unit for treatment | | | | |
| aromatics mass content(wt %) | 30.7 | 30.7 | 30.7 | 30.7 |
| monocyclic aromatics content(wt %), based on 100 wt % aromatics content | 23.3 | 23.3 | 23.3 | 23.3 |
| stream sent to second hydrogenation cracking unit for treatment | | | | |
| sum of naphthenes and aromatics contents(wt %) | 84.47 | 84.47 | 84.47 | 76.57 |
| conversion of >350° C. fraction in first hydrogenation cracking unit/% | 47.1 | 47.1 | 47.1 | 65 |
| conversion of paraffins in first hydrogenation cracking unit/% | 66.8 | 66.8 | 66.8 | 68.3 |
| conversion of naphthenes + aromatic in first hydrogenation cracking unit/% | 52.85 | 52.85 | 52.85 | 70.5 |
| conversion of >350° C. fraction in second hydrogenation cracking unit/% | 56.25 | 72.40 | 88.50 | 56.25 |
| product yield and properties | | | | |
| low carbon light hydrocarbon yield/weight %(C3 + C4) | 13.26 | 13.26 | 13.26 | 18.5 |
| light fraction I | | | | |
| yield/weight % | 6.41 | 5.41 | 6.41 | 11.0 |
| distillation range (IBP-FBP)/° C. | 30-100 | 30-100 | 30-100 | 30-100 |
| hydrocarbon composition (PONA)/% | | | | |
| paraffins (n- + iso-paraffins) | 91.74 | 91.74 | 91.74 | 88.25 |
| naphthenes + aromatics | 8.26 | 8.26 | 8.26 | 11.75 |

TABLE 6-continued

| Item | Example 4 | Example 5 | Comparative Example 4 | Comparative Example 5 |
|---|---|---|---|---|
| heavy fraction I | | | | |
| yield/weight % | 80.33 | 80.33 | 80.33 | 70.50 |
| mass fraction of >350° C. fraction in heavy fraction I/% | 59.29 | 59.29 | 59.29 | 44.68 |
| Hydrocarbon compoition of >350° C. fraction of heavy fraction I/% | | | | |
| paraffins | 15.3 | 15.3 | 15.3 | 19.6 |
| naphthenes + aromatics | 84.7 | 84.7 | 84.7 | 80.4 |
| light fraction II | | | | |
| yield/weight % | 9.74 | 17.66 | 22.55 | 5.8 |
| distillation range (IBP-FBP)/° C. | 65-175 | 65-175 | 65-175 | 65-175 |
| hydrocarbon composition (PONA)/% | | | | |
| paraffins (n- + iso-paraffins) | 35.63 | 40.36 | 43.33 | 39.64 |
| naphthenes + aromatics | 64.37 | 59.64 | 55.9 | 61.36 |
| heavy fraction II | | | | |
| yield/weight % | 70.59 | 62.67 | 57.78 | 64.70 |
| mass fraction of (280-370° C.) fraction of heavy fraction II/% | 32.24 | 35.25 | 37.11 | 33.24 |
| condensation point/° C. | <−50 | <−50 | <−50 | <−50 |
| kinematic viscosity@40° C./($mm^2$/s) | 7.801 | 6.725 | 6.023 | 7.814 |
| polycyclic aromatics (PCA) content/% | <3.0 | <3.0 | <3.0 | <3.0 |
| mass fraction of >350° C. fraction of heavy fraction II/% | 29.52 | 20.97 | 9.48 | 21.33 |
| condensation point of >350° C. fraction of heavy fraction II/° C. | −38 | −35 | −30 | −45 |
| kinematic viscosity@100° C. of >350° C. fraction of heavy fraction II/($mm^2$/s) | 5.561 | 4.721 | 4.326 | 5.732 |
| hydrocarbon composition of >350° C. fraction of heavy fraction II/% | | | | |
| paraffins | 34.9 | 37.0 | 56.1 | 40.1 |
| naphthenes | 63.4 | 60.6 | 41.8 | 57.5 |
| aromatics | 1.7 | 2.4 | 2.1 | 2.4 |
| polycyclic aromatics (PCA) content, % | <3.0 | <3.0 | <3.0 | <3.0 |

TABLE 7

| Item | Example 6 | Comparative Example 6 | Comparative Example 7 |
|---|---|---|---|
| feedstock | Intermediate-base VGO feedstock | | |
| catalyst | | | |
| hydrotreating unit (catalyst loading volume ratio) | VRG-30A/VRG-30B/VRAM-10/VRJW-3 = 5 :8:8:77 | | |
| first hydrogenation cracking unit | cracking agent 5 | cracking agent 6 | cracking agent 7 |
| second hydrogenation cracking unit | treating agent | treating agent | treating agent |
| process condition parameters | | | |
| hydrogen partial pressure of hydrotreating unit/MPa | 14 | 14 | 14 |
| hydrogen partial pressure of first hydrogenation cracking unit/MPa | 14 | 14 | 14 |
| hydrogen partial pressure of second hydrogenation cracking unit/MPa | 14 | 14 | 14 |
| reaction temperature of hydrotreating unit/° C. | 365 | 365 | 365 |
| reaction temperature of first hydrogenation cracking unit/° C. | 370 | 400 | 350 |
| reaction temperature of second hydrogenation cracking unit/° C. | 365 | 365 | 350 |
| protection agent LHSV/$h^{-1}$ | 12.7 | 12.7 | 12.7 |
| demetallization agent LHSV/$h^{-1}$ | 22.3 | 22.3 | 22.3 |
| refining catalyst LHSV/$h^{-1}$ | 1.0 | 1.0 | 1.0 |
| LHSV of first hydrogenation cracking unit/$h^{-1}$ | 1.4 | 1.4 | 1.4 |
| LHSV of second hydrogenation cracking unit/$h^{-1}$ | 3.0 | 3.0 | 3.0 |

TABLE 7-continued

| Item | Example 6 | Comparative Example 6 | Comparative Example 7 |
|---|---|---|---|
| $H_2$/oil ratio by volume of hydrotreating | 800 | 800 | 800 |
| $H_2$/oil ratio by volume of first hydrogenation cracking unit | 1200 | 1200 | 1200 |
| $H_2$/oil ratio by volume of second hydrogenation cracking unit | 1200 | 1200 | 1200 |
| nitrogen content of liquid phase product in hydrotreating unit/(μg/g) | 8.5 | 8.5 | 8.6 |
| aromatics saturation rate of feedstock in hydrotreating unit/% | 50 | 50 | 50 |
| stream sent to first hydrogenation cracking unit for treatment | | | |
| aromatics mass content(wt %) | 25.0 | 25.0 | 25.0 |
| monocyclic aromatics content(wt %), based on 100 wt % aromatics content | 19.38 | 19.38 | 19.38 |
| stream sent to second hydrogenation cracking unit for treatment | | | |
| sum of naphthenes and aromatics contents(wt %) | 81.53 | 73.81 | 71.7 |
| conversion of >350° C. fraction in first hydrogenation cracking unit/% | 49.4 | 48.5 | 50.5 |
| conversion of paraffins in first hydrogenation cracking unit/% | 66.76 | 52.4 | 66.76 |
| conversion of naphthenes + aromatic in first hydrogenation cracking unit/% | 52.8 | 68.5 | 69.5 |
| conversion of >350° C. fraction in second hydrogenation cracking unit/% | 20 | 20 | 20 |
| product yield and properties | | | |
| low carbon light hydrocarbon yield/weight %(C3 + C4) | 10.8 | 8.5 | 15.6 |
| light fraction I | | | |
| yield/weight % | 8.52 | 9.20 | 8.2 |
| distillation range (IBP-FBP)/° C. | 30-100 | 30-100 | 30-100 |
| hydrocarbon composition (PONA)/% | | | |
| paraffins (n- + iso-paraffins) | 93.0 | 85.2 | 86.0 |
| naphthenes + aromatics | 7.0 | 14.8 | 14.0 |
| heavy fraction I | | | |
| yield/weight % | 80.68 | 82.30 | 76.2 |
| mass fraction of >350° C. fraction in heavy fraction I/% | 56.43 | 56.31 | 58.46 |
| Hydrocarbon compoition of >350° C. fraction of heavy fraction I/% | | | |
| paraffins | 17.0 | 24.0 | 26.0 |
| naphthenes + aromatics | 83.0 | 76.0 | 74.0 |
| light fraction II | | | |
| yield/weight % | 4.2 | 3.85 | 4.6 |
| distillation range (IBP-FBP)/° C. | 65-175 | 65-175 | 65-175 |
| hydrocarbon composition (PONA)/% | | | |
| paraffins (n- + iso-paraffins) | 37.1 | 42.0 | 40.0 |
| naphthenes + aromatics | 63 | 58.0 | 60.0 |
| heavy fraction II | | | |
| yield/weight % | 76.48 | 78.45 | 71.6 |
| mass fraction of (280-370° C.) fraction of heavy fraction II/% | 33.90 | 34.45 | 34.30 |
| condensation point/° C. | <−50 | −35 | −40 |
| kinematic viscosity@40° C./($mm^2$/s) | 6.964 | 6.716 | 6.810 |
| polycyclic aromatics (PCA) content/% | <3.0 | <3.0 | <3.0 |
| mass fraction of >350° C. fraction of heavy fraction II 1% | 47.62 | 47.26 | 49.78 |
| condensation point of >350° C. fraction of heavy fraction II/° C. | −40 | −28 | −38 |
| kinematic viscosity@100° C. of >350° C. fraction of heavy fraction II/($mm^2$/s) | 5.226 | 5.167 | 5.250 |
| hydrocarbon composition of >350° C. fraction of heavy fraction II/% | | | |
| paraffins | 21.2 | 27.0 | 26.0 |
| naphthenes | 78.5 | 72.8 | 73.7 |

TABLE 7-continued

| Item | Example 6 | Comparative Example 6 | Comparative Example 7 |
|---|---|---|---|
| aromatics | 0.3 | 0.2 | 0.3 |
| polycyclic aromatics (PCA) content, % | <3.0 | <3.0 | <3.0 |

TABLE 8

| naphthenic speciality oil I GB 2536-2011 Fluids for electrotechnical applications-unused mineral insulating oils for transformers and switchgear | | naphthenic speciality oil II GB/T 16630 refrigerator oil | |
|---|---|---|---|
| product brand | −40° C. transformer oil | product brand | |
| kinematic viscosity/ ($mm^2/s$) | | kinematic viscosity/ ($mm^2/s$) | |
| 40° C. | ≤12 | 40° C. | 6.12-500 |
| 0° C. | — | 100° C. | report |
| flash point (closed)/° C. | ≥135 | flash point (closed)/° C. | ≥130 |
| pour point/° C. | ≤-40° C. | pour point/° C. | ≤-18/−15/−10° C. |
| polycyclic aromatics (PCA) content/% | <3.0 | | |

The invention claimed is:

1. A hydrocracking process, comprising:

(1) in a hydrotreating unit, a mixture of gas oil feedstock and hydrogen gas is reacted by successively contacting a hydrogenation protection agent, an optional hydrodemetallization catalyst, and a hydrorefining catalyst, to produce a reaction effluent;

(2) in a first hydrogenation cracking unit, the reaction effluent obtained from step (1) is sent to the first hydrogenation cracking unit, and reacted by contacting a hydrogenation cracking catalyst I in presence of hydrogen gas, the resulting reaction effluent is separated to at least produce light fraction I and heavy fraction I; the light fraction I is rich in paraffins, the mass fraction of paraffins in the light fraction I is at least 82%, the heavy fraction I is rich in naphthenes and aromatics, in hydrocarbon composition of the >350° C. fraction of the heavy fraction I, the sum of the mass fractions of naphthenes and aromatics is higher than 82%, the hydrogenation cracking catalyst I comprises a support and an active metal component, the support comprises a heat-resistant inorganic oxide and a molecular sieve, the heat-resistant inorganic oxide is one or more of silica and alumina, the active metal component is at least two metal components of Group VIB metals and Group VIII metals; the molecular sieve is one or more of molecular sieves ZSM-5, ZSM-11, ZSM-12, ZSM-22, ZSM-23, ZSM-48, ZSM-50, IM-5, MCM-22, and EU-1;

(3) in a second hydrogenation cracking unit, the heavy fraction I obtained in step (2) is sent to the second hydrogenation cracking unit, and reacted by contacting a hydrogenation cracking catalyst II and/or a hydrotreating catalyst in presence of hydrogen gas, the resulting reaction effluent is separated to at least produce light fraction II and heavy fraction II.

2. The process according to claim 1, wherein the gas oil feedstock has an initial boiling point of 300-350° C. and is one or more of atmospheric gas oil, vacuum gas oil, hydrogenated gas oil, coker gas oil, catalytic cracking heavy cycle oil, and deasphalted oil.

3. The process according to claim 1, wherein in the hydrotreating unit, based on the whole catalyst of the hydrotreating unit, the loading volumetric fractions of the hydrogenation protection agent, the optional hydrodemetallization catalyst, and the hydrorefining catalyst are 3%-10%; 0%-20%; and 70%-90% respectively.

4. The process according to claim 1, wherein the hydrotreating unit has the following reaction conditions:

hydrogen partial pressure: 3.0 MPa-20.0 MPa, reaction temperature: 280° C.-400° C., LHSV (based on the hydrorefining catalyst): 0.5 $h^{-1}$-6 $h^{-1}$, $H_2$/oil ratio by volume: 300-2000.

5. The process according to claim 1, wherein the hydrogenation protection agent contains a support and, loaded on the support, an active metal component, the support is one or more of alumina, silica, and titania, the active metal component is one or more of Group VIB metal(s), and Group VIII non-precious metal(s), based on the weight of the hydrogenation protection agent, as oxide, the active metal component comprises 0.1-15 wt %, the hydrogenation protection agent has a particle size of 0.5-50.0 mm, a bulk density of 0.3-1.2 $g/cm^3$, and a specific surface area of 50-300 $m^2/g$.

6. The process according to claim 1, wherein the hydrodemetallization catalyst contains a support and, loaded on the support, an active metal component, the support is one or more of alumina, silica, and titania, the active metal component is one or more of Group VIB metal(s), and Group VIII non-precious metal(s), based on the weight of the hydrodemetallization catalyst, as oxide, the active metal component comprises 3-30 wt %, the hydrodemetallization catalyst has a particle size of 0.2-2.0 mm, a bulk density of 0.3-0.8 $g/cm^3$, and a specific surface area of 100-250 $m^2/g$.

7. The process according to claim 1, wherein the hydrorefining catalyst is a supported catalyst, the support is alumina and/or silica-alumina, the active metal component is at least one selected from Group VIB metals and/or at least one selected from Group VIII metals; the Group VIII metal is Ni and/or Co, the Group VIB metal is Mo and/or W, based on the total weight of the hydrorefining catalyst, as oxide, the content of Group VIII metal(s) is 1-15 wt %, the content of Group VIB metal(s) is 5-40 wt %.

8. The process according to claim 7, wherein the active metal component of the hydrorefining catalyst is two or three of metals Ni, Mo and W.

9. The process according to claim 1, wherein in the hydrotreating unit, an aromatics saturation rate of feedstock is controlled to less than or equal to 58%; optionally, the aromatics saturation rate of feedstock=100%*(the content of aromatics in feedstock–the content of aromatics in reaction effluent of hydrotreating unit)/the content of aromatics in feedstock.

10. The process according to claim 1, wherein the first hydrogenation cracking unit has the following reaction conditions: hydrogen partial pressure: 3.0 MPa-20.0 MPa, reaction temperature: 280° C.-430° C., LHSV: 0.5 $h^{-1}$-6 $h^{-1}$, $H_2$/oil ratio by volume: 300-2000.

11. The process according to claim 1, wherein the conversion of >350° C. fraction in the first hydrogenation cracking unit is controlled to the following range:

from 100*(Awt %/the mass fraction of >350° C. fraction in gas oil feedstock) to 100*(Bwt %/the mass fraction of >350° C. fraction in gas oil feedstock), wherein, A is the mass fraction of paraffins in gas oil feedstock, B is the sum of mass fractions of paraffins, monocycloparaffins, and monocyclic aromatics in gas oil feedstock, wherein, the conversion of >350° C. fraction in the first hydrogenation cracking unit=100%*(the mass fraction of >350° C. fraction in gas oil feedstock–the mass fraction of >350° C. fraction in the reaction product of the first hydrogenation cracking unit)/the mass fraction of >350° C. fraction in gas oil feedstock.

12. The process according to claim 1, wherein the hydrogenation cracking catalyst I comprises a support and an active metal component, the support comprises a heat-resistant inorganic oxide and a molecular sieve, the heat-resistant inorganic oxide is one or more of silica and alumina, the active metal component is at least two metal components of Group VIB metals and Group VIII metals; the molecular sieve is one or more of molecular sieves ZSM-5, ZSM-11, ZSM-12, ZSM-22, ZSM-23, ZSM-48, ZSM-50, IM-5, MCM-22, and EU-1; based on the whole of hydrogenation cracking catalyst I, as oxide, Group VIB metal comprises 10 wt %-35 wt %, Group VIII metal comprises 2 wt %-8 wt %;

based on the support, the molecular sieve comprises 10 wt %-75 wt %, the balance is the heat-resistant inorganic oxide;

the molecular sieve has a silica/alumina molar ratio of 20-50, a pore size of 0.4 nm-0.58 nm, a specific surface area of 200 $m^2$/g-400 $m^2$/g.

13. The process according to claim 1, wherein the second hydrogenation cracking unit has the following reaction conditions: hydrogen partial pressure: 3.0 MPa-20.0 MPa, reaction temperature: 280° C.-430° C., LHSV: 0.5 $h^{-1}$-6 $h^{-1}$, $H_2$/oil ratio by volume: 300-2000.

14. The process according to claim 1, wherein the conversion of >350° C. fraction in the second hydrogenation cracking unit is controlled to a range of 5%-80%, wherein, the conversion of >350° C. fraction in the second hydrogenation cracking unit=100%*(the mass fraction of >350° C. fraction of heavy fraction I–the mass fraction of >350° C. fraction of heavy fraction II)/the mass fraction of >350° C. fraction of heavy fraction I.

15. The process according to claim 1, wherein the hydrogenation cracking catalyst II comprises a support and an active metal component, said support comprises heat-resistant inorganic oxides and Y-type molecular sieves, the heat-resistant inorganic oxide is one or more of silica, alumina, and titania, the active metal component is at least two metal components of Group VIB metals and Group VIII metals; based on the whole of hydrogenation cracking catalyst II, as oxide, Group VIB metal comprises 10 wt %-35 wt %, Group VIII metal comprises 2 wt %-8 wt %;

based on the support, the Y-type molecular sieve comprises 5 wt %-55 wt %, the balance is the heat-resistant inorganic oxide;

optionally, in the case that the second hydrogenation cracking unit is loaded with the hydrogenation cracking catalyst, the reaction temperature of second hydrogenation cracking unit is 0-30° C. higher than the temperature of the first hydrogenation cracking unit.

16. The process according to claim 1, wherein the hydrotreating catalyst is a supported catalyst, the support is alumina or silica-alumina, the active metal component is at least one selected from Group VIB metals and/or at least one selected from Group VIII metals, the Group VIII metal is Ni and/or Co, the Group VIB metal is Mo and/or W, based on the total weight of the hydrotreating catalyst, as oxide, the content of Group VIII metal(s) is 1-15 wt %, the content of Group VIB metal(s) is 5-40 wt %;

optionally, in the case that the second hydrogenation cracking unit is loaded with the hydrotreating catalyst, the reaction temperature of second hydrogenation cracking unit is 0-35° C. lower than the temperature of the first hydrogenation cracking unit.

17. The process according to claim 1, wherein the resulting reaction effluent of the first hydrogenation cracking unit is separated to produce light fraction I and heavy fraction I, light fraction I has an initial boiling point of 20° C.-30° C., light fraction I and heavy fraction I have a cutting point of 65° C.-120° C.; the mass fraction of paraffins in the light fraction I is at least 85%.

18. The process according to claim 1, wherein the resulting reaction effluent of the first hydrogenation cracking unit is separated to produce light fraction I and heavy fraction I, light fraction I has an initial boiling point of 20° C.-30° C., light fraction I and middle fraction I have a cutting point of 65° C.-120° C., middle fraction I and heavy fraction I have a cutting point of 160-180° C., the light fraction I is rich in paraffins, e mass fraction of paraffins in the light fraction I is at least 85%.

19. The process according to claim 1, wherein light fraction II has an initial boiling point of 65° C.-100° C., light fraction II and heavy fraction II have a cutting point of 155-180° C.;

the light fraction II has a total mass fraction of naphthenes and aromatics of at least 58%, the mass fraction of naphthenes in the >350° C. fraction of heavy fraction II is at least 50%.

20. The process according to claim 1, wherein the mass content of aromatics+naphthenes in the hydrocarbons of the gas oil feedstock is greater than 70%.

21. The process according to claim 1, wherein the process condition parameters of reaction temperature, LHSV, $H_2$/oil ratio and reaction pressure of the first hydrogenation cracking unit are adjusted and controlled so that the conversion of paraffins in the feedstock is 56%-95%, the total conversion of naphthenes and aromatics is 10%-65%.

22. The process according to claim 1, wherein a stream that is sent to the first hydrogenation cracking unit for treatment has an aromatics mass content of 10 wt %-40 wt %, and on the basis that the content of aromatics is 100 wt %, the content of monocyclic aromatics is 60 wt %-85 wt %.

23. The process according to claim 1, wherein a stream that is sent to the second hydrogenation cracking unit for treatment has a total mass content of naphthenes and aromatics of 75 wt %-90 wt %.

24. The process according to claim 1, wherein in the first hydrogenation cracking unit, the hydrogenation cracking catalyst I comprises a support and an active metal component, the support comprises a heat-resistant inorganic oxide and a molecular sieve, the heat-resistant inorganic oxide is one or more of silica and alumina, the active metal component is at least two metal components of Group VIB metals and Group VIII metals; the molecular sieve is ZSM-5; based on the whole of hydrogenation cracking catalyst I, as oxide, Group VIB metal comprises 10 wt %-35 wt %, Group VIII metal comprises 2 wt %-8 wt %; based on the support, the molecular sieve comprises 35 wt %-45 wt %, the balance is the heat-resistant inorganic oxide; the molecular sieve has a silica/alumina molar ratio of 20-50, a pore size of 0.4 nm-0.58 nm, a specific surface area of 200 $m^2$/g-400 $m^2$/g.

25. The process according to claim 1, wherein in the first hydrogenation cracking unit, a fraction cutting is performed at 65° C.-120° C., and optionally a fraction cutting is performed at 160° C.-180° C.

26. The process according to claim 1, wherein the gas oil feedstock has an initial boiling point of 300-350° C., a final boiling point of 520-650° C., and a density at 20° C. of 0.890 g/$cm^3$-0.940 g/$cm^3$; the mass content of aromatics+naphthenes in the hydrocarbons of the gas oil feedstock is greater than 70%; and the gas oil feedstock is one or more of atmospheric gas oil, vacuum gas oil, hydrogenated gas oil, coker gas oil, catalytic cracking heavy cycle oil, and deasphalted oil.

27. The process according to claim 1, wherein in the first hydrogenation cracking unit, one or more process condition parameters of reaction temperature, LHSV, $H_2$/oil ratio and reaction pressure, of the first hydrogenation cracking unit are adjusted and controlled so that the conversion of paraffins in the feedstock is 56%-95%, the total conversion of naphthenes and aromatics is 10%-65%, wherein the conversion of paraffins=(the content of paraffins in the feedstock−the content of paraffins in the >350° C. fraction of the product of the first hydrogenation cracking unit*the mass fraction of the >350° C. fraction in the product of the first hydrogenation cracking unit)/the content of paraffins in the feedstock;

the total conversion of naphthenes and aromatics=(the total content of naphthenes and aromatics in the feedstock−the total content of naphthenes and aromatics in >350° C. fraction of the product of the first hydrogenation cracking unit*the mass fraction of the >350° C. fraction in the product of the first hydrogenation cracking unit)/the total content of naphthenes and aromatics in the feedstock.

28. An apparatus for performing the process according to claim 1, comprising a hydrotreating unit, a first hydrogenation cracking unit, and a second hydrogenation cracking unit;

the hydrotreating unit is provided with a gas oil feedstock inlet, a hydrogen gas inlet, and a reaction effluent outlet, in the hydrotreating unit are successively loaded a hydrogenation protection agent, optionally a hydrodemetallization catalyst, and a hydrorefining catalyst;

the first hydrogenation cracking unit is provided with a first hydrogenation cracking system and a first separation system, in the first hydrogenation cracking system is loaded a hydrogenation cracking catalyst I, the first hydrogenation cracking system is provided with an inlet for the reaction effluent of the hydrotreating unit, which is communicated with the reaction effluent outlet of the hydrotreating unit, a reaction effluent outlet of the first hydrogenation cracking system is communicated with an inlet of the first separation system, the first separation system is at least provided with a first hydrogen-rich gas outlet, a light fraction I outlet and a heavy fraction I outlet;

the second hydrogenation cracking unit is provided with a second hydrogenation cracking system and a second separation system, in the second hydrogenation cracking system are loaded a hydrogenation cracking catalyst II and/or a hydrotreating catalyst, the second hydrogenation cracking system is provided with an inlet for heavy fraction I, which is communicated with the heavy fraction I outlet of the first separation system, a reaction effluent outlet of the second hydrogenation cracking system is communicated with an inlet for the second separation system, the second separation system is at least provided with a second hydrogen-rich gas outlet, a light fraction II outlet, and a heavy fraction II outlet;

the hydrogenation cracking catalyst I comprises a support and an active metal component, the support comprises a heat-resistant inorganic oxide and a molecular sieve, the heat-resistant inorganic oxide is one or more of silica and alumina, the active metal component is at least two metal components of Group VIB metals and Group VIII metals; the molecular sieve is one or more of molecular sieves ZSM-5, ZSM-11, ZSM-12, ZSM-22, ZSM-23, ZSM-48, ZSM-50, IM-5, MCM-22, and EU-1.

29. The apparatus according to claim 28, wherein in the first hydrogenation cracking unit, the hydrogenation cracking catalyst I comprises a support and an active metal component, the support comprises a heat-resistant inorganic oxide and a molecular sieve, the heat-resistant inorganic oxide is one or more of silica and alumina, the active metal component is at least two metal components of Group VIB metals and Group VIII metals; the molecular sieve is ZSM-5, ZSM-11, ZSM-12, ZSM-22, ZSM-23, ZSM-48, ZSM-50, IM-5, MCM-22, and EU-1, based on the support, the molecular sieve comprises 10 wt %-75 wt %, the balance is the heat-resistant inorganic oxide; the molecular sieve has a silica/alumina molar ratio of 20-50, and a pore size of 0.4 nm-0.58 nm;

in the first hydrogenation cracking unit, a control device is provided to control a fraction cutting to be performed at 65° C.-120° C., and optionally a control device is provided to control a fraction cutting to be performed at 160-180° C.;

wherein the hydrogenation cracking catalyst II comprises a support and an active metal component, said support comprises heat-resistant inorganic oxides and Y-type molecular sieves, the heat-resistant inorganic oxide is one or more of silica, alumina, and titania, the active metal component is at least two metal components of Group VIB metals and Group VIII metals; based on the whole of hydrogenation cracking catalyst II, as oxide, Group VIB metal comprises 10 wt %-35 wt %, Group VIII metal comprises 2 wt %-8 wt %;

based on the support, the Y-type molecular sieve comprises 5 wt %-55 wt %, the balance is the heat-resistant inorganic oxide;

wherein the hydrotreating catalyst is a supported catalyst, the support is alumina or silica-alumina, the active metal component is at least one selected from Group VIB metals and/or at least one selected from Group VIII metals, the Group VIII metal is Ni and/or Co, the Group VIB metal is Mo and/or W, based on the total weight of the hydrotreating catalyst, as oxide, the content of Group VIII metal(s) is 1-15 wt %, the content of Group VIB metal(s) is 5-40 wt %.

30. The process according to claim 1, wherein in the first hydrogenation cracking unit, reaction temperature and LHSV of the first hydrogenation cracking unit are adjusted and controlled so that the conversion of paraffins in the feedstock is 56%-95%, the total conversion of naphthenes and aromatics is 10%-65%, wherein the conversion of paraffins=(the content of paraffins in the feedstock−the content of paraffins in the >350° C. fraction of the product of the first hydrogenation cracking unit*the mass fraction of the >350° C. fraction in the product of the first hydrogenation cracking unit)/the content of paraffins in the feedstock;

the total conversion of naphthenes and aromatics=(the total content of naphthenes and aromatics in the feedstock−the total content of naphthenes and aromatics in >350° C. fraction of the product of the first hydrogenation cracking unit*the mass fraction of the >350° C. fraction in the product of the first hydrogenation cracking unit)/the total content of naphthenes and aromatics in the feedstock.

* * * * *